United States Patent [19]

Deguchi et al.

[11] Patent Number: 4,945,033

[45] Date of Patent: Jul. 31, 1990

[54] DIRECT POSITIVE PHOTOGRAPHIC MATERIALS

[75] Inventors: Naoyasu Deguchi; Shigeru Ohno, both of Kanagawa, Japan

[73] Assignee: Fuji Photo Film Co., Ltd., Kanagawa, Japan

[21] Appl. No.: 291,017

[22] Filed: Dec. 28, 1988

[30] Foreign Application Priority Data

Dec. 28, 1987 [JP] Japan ..... 62-335568

[51] Int. Cl.[5] ..... G03C 1/84

[52] U.S. Cl. ..... 430/522; 430/595; 430/598

[58] Field of Search ..... 430/522, 595, 598

[56] References Cited

U.S. PATENT DOCUMENTS 3,989,528 11/1976 Sugiyama et al. ..... 430/522
4,587,195 5/1986 Ishikawa et al. ..... 430/139
4,789,627 12/1988 Inoue et al. ..... 430/406

FOREIGN PATENT DOCUMENTS 1553516 10/1979 United Kingdom .

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

A direct positive photographic material which has at least one previously-not-fogged internal latent image-type silver halide emulsion layer on a support, wherein the photographic material contains at least one compound represented by the following formula (I):

(I)

wherein each of $R_1$ and $R_2$ represents an alkyl group, an aryl group, a cyano group, —$COOR_5$, —$CONR_5R_6$, —$OR_5$, —$NR_5R_6$, —$NR_6COR_7$, —$NR_5CONR_5R_6$, —$NR_6SO_2R_7$ (each of $R_5$ and $R_6$ represents a hydrogen atom, an alkyl group or an aryl group; $R_7$ represents an alkyl or aryl group; $R_5$ and $R_6$, or $R_6$ and $R_7$ may link together to form a 5- or 6-membered ring); each of $R_3$ and $R_4$ represents a hydrogen atom or an alkyl group; each of $Q_1$ and $Q_2$ represents an aryl group; each of $X_1$ and $X_2$ represents a bond or a divalent linking group; each of $Y_1$ and $Y_2$ represents a sulfo group or a carboxyl group; each of $L_1$, $L_2$ and $L_3$ represents a methine group; n represents 0, 1, or 2; each of $m_1$ and $m_2$ represents 1 or 2; each of $p_1$ and $p_2$ represents 0, 1, 2, 3 or 4; and each of $q_1$ and $q_2$ represents 1 or 2.

The photographic materials show no change in photographic performance after preservation under high temperature and high humidity and give images of high sharpness.

20 Claims, No Drawings

DIRECT POSITIVE PHOTOGRAPHIC MATERIALS

FIELD OF THE INVENTION

The present invention relates to photographic materials, and more particularly to direct positive photographic materials that retain high sharpness and good stability even after a lapse of time.

BACKGROUND OF THE INVENTION

A reversal process or a photographic process for directly obtaining positive images without using any negative film is well known.

As a process for directly forming positive images with an internal latent image type silver halide emulsion, there are various known arts, for example, those disclosed in the specifications of U.S. Pat. Nos. 2,592,250; 2,466,957; 2,497,875; 2,588,982; 3,317,322; 3,761,266; 3,761,276; 3,796,577; British Patents 1,51,363, and 1,150,553.

In general, direct positive color photographic materials containing internal latent image type silver halide emulsion layers which are not previously fogged are processed by carrying out image-wise exposure, then fog-exposure prior to or during development using a surface color developing solution containing an aromatic primary amine color developing agent and/or development using the surface color developing solution in the presence of a nucleating agent, bleaching and fixing.

The improvement of image quality, particularly that of sharpness is the important aim of the direct positive photographic materials, which has been studied in various aspects.

As one of the means of achieving the above improvement, there is known the use of irradiation-preventing dyes. Pyrazolone 1-position sulfoaryl type dyes are described in JP-B-51-46607, JP-B-39-22069, JP-B-60-53304 and JP-B-55-10061 (the term "JP-B" as used herein means an "examined Japanese patent publication"). The cases using pyrazolone 1-position sulfoalkyl type dyes are illustrated in JP-B-55-10059 and JP-A-51-32325 (the term "JP-A" as used herein means an "unexamined published Japanese patent application").

However, the application of these dyes to previously-not-fogged internal latent image type direct positive photographic materials may improve the sharpness but undesirably cause desensitization when preserved for long periods of time or at high temperature. In particular, the preservation thereof at relatively high temperature causes remarkable desensitization. On the other hand, pyrazolone 1-position sulfoaralkyl types dyes are disclosed in JP-A-50-145125 (corresponding to British Patent 1,466,836), JP-A-50-144712 (corresponding to U.S. Pat. No. 3,989,528), and JP-A-52-20830 (corresponding to British Patent 1,553,516), but the application thereof to the previously-not-fogged internal latent image type direct positive photographic materials is not mentioned at all.

SUMMARY OF THE INVENTION

Accordingly, the object of the present invention is to provide direct positive photographic materials that do not cause any change of photographic performance during preservation and give images of improved sharpness.

The above object of the present invention can be obtained by providing a direct positive photographic material having at least one previously-not-fogged internal latent image type silver halide emulsion layer on a support, wherein the photographic material contains at least one compound represented by the following formula (I):

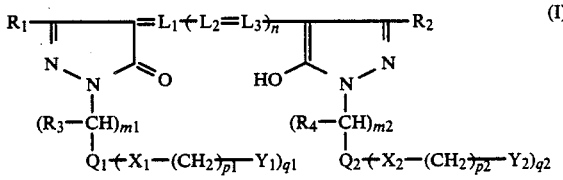

(I)

wherein each of $R_1$ and $R_2$ represents an alkyl group, an aryl group, a cyano group, $-COOR_5$, $-CONR_5R_6$, $-OR_5$, $-NR_5R_6$, $-NR_6COR_7$, $-NR_5CONR_5R_6$, $-NR_6SO_2R_7$ (each of $R_5$ and $R_6$ represents a hydrogen atom, an alkyl group, or an aryl group; $R_7$ represents an alkyl or aryl group; $R_5$ and $R_6$, or $R_6$ and $R_7$ may link together to form a 5- or 6-membered ring); each of $R_3$ and $R_4$ represents a hydrogen atom or an alkyl group; each of $Q_1$ and $Q_2$ represents an aryl group; each of $X_1$ and $X_2$ represents a bond or a divalent linking group; each of $Y_1$ and $Y_2$ represents a sulfo group or a carboxyl group; each of $L_1$, $L_2$ and $L_3$ represents a methine group; n represents 0, 1, or 2; each of $m_1$ and $m_2$ represents 1 or 2; each of $p_1$ and $p_2$ represents 0, 1, 2, 3 or 4; and each of $q_1$ and $q_2$ represents 1 or 2.

DETAILED DESCRIPTION OF THE INVENTION

The following is a more detailed explanation of the compounds represented by the above formula (I).

The alkyl group represented by $R_1$, $R_2$, $R_5$, $R_6$ or $R_7$ is preferably an alkyl group having 1 to 8 carbon atoms (e.g., methyl, ethyl, n-propyl, n-butyl, t-butyl, isopropyl, n-amyl, n-hexyl, isobutyl, n-octyl), which may have a substituent, such as a halogen atom (e.g., fluorine, chlorine, bromine), a phenyl group, a hydroxy group, a cyano group, an alkoxy group (e.g., methoxy, ethoxy, hydroxyethoxy), an aryloxy group (e.g., phenoxy, p-methoxyphenoxy), a carboxyl group and sulfo group.

The alkyl group represented by $R_3$ or $R_4$ is preferably an alkyl group having 4 or less carbon atoms (e.g., methyl, ethyl, n-propyl).

The aryl group represented by $R_1$, $R_2$, $R_5$, $R_6$ or $R_7$ is preferably a phenyl group or a naphthyl group, which may have a substituent, such as a halogen atom (e.g., fluorine, chlorine, bromine), a sulfo group, a carboxyl group, a hydroxyl group, a cyano group, an alkyl group having 1 to 4 carbon atoms (e.g., methyl, ethyl, n-propyl), an alkoxy group (e.g., methoxy, ethoxy) and an aryloxy group (e.g., phenoxy).

The aryl group represented by $Q_1$ or $Q_2$ is preferably a phenyl group or a naphthyl group, which may have a substituent, excluding a sulfo group and a carboxyl group, such as an alkyl group having 1 to 4 carbon atoms (e.g., methyl, ethyl), an alkoxy group (e.g., methoxy, ethoxy), a halogen atom (e.g., fluorine, chlorine, bromine), a carbamoyl group (e.g., ethylcarbamoyl), a sulfamoyl group (e.g., ethyl sulfamoyl), a cyano group, a nitro group, an alkylsulfonyl group (e.g., methanesulfonyl), an arylsulfonyl group (e.g., benzenesulfonyl), an amino group (e.g., dimethylamino, diethylamino), an acylamino group (e.g., acetylamino), a sulfonamido group (e.g., methanesulfonamido) and a hydroxyl group.

As the divalent linking groups represented by $X_1$ or $X_2$, there are given, for example, $$-O-,\ -\overset{R_8}{\overset{|}{N}}-,\ -\overset{R_8}{\overset{|}{N}}-CO-,\ -SO_2-,\ \text{and}\ -\overset{R_8}{\overset{|}{N}}-SO_2-,$$

wherein $R_8$ represents a hydrogen atom, an alkyl group having 5 or less carbon atoms (e.g., methyl, ethyl, n-propyl, n-butyl, n-amyl), a substituted alkyl group having 5 or less carbon atoms [as a substituent, an alkoxy group having 3 or less carbon atoms (e.g., methoxy, ethoxy), a sulfo group, a carboxyl group, a cyano group, a hydroxyl group, an amino group (e.g., dimethylamino, diethylamino), a carbamoyl group (e.g., hydroxyethylaminocarbonyl, ethylaminocarbonyl), and a sulfamoyl group (e.g., ethylaminosulfonyl)].

As the 5- or 6-membered rings which are formed by linking $R_5$ and $R_6$, or $R_6$ and $R_7$ together, there are given, for example, a piperidine ring, a morpholine ring, a pyrrolidine ring, and a pyrrolidone ring.

The methine group represented by $L_1$, $L_2$ or $L_3$ may have a substituent (e.g., methyl, ethyl, cyano, chlorine, sulfoethyl).

In the above general formula, the sulfo group or the carboxyl group represented by $Y_1$ or $Y_2$ may be present in the form of the free acid or salt (e.g., a sodium salt, a potassium salt, a $(C_2H_5)_3NH$ salt, a pyridinium salt, an ammonium salt).

The preferable compounds are represented by formula (I) wherein each of $R_3$ and $R_4$ represents a hydrogen atom or a methyl group; each of $Q_1$ and $Q_2$ represents a phenyl group, a substituted phenyl group which may preferably include as a substituent an alkyl group having 4 or less carbon atoms, an alkoxy group having 4 or less carbon atoms, a halogen atom (e.g., Cl, Br, F), and a dialkylamino group having 4 or less carbon atoms; and each of $X_1$ and $X_2$ represents —O—, $$-\overset{R_8}{\overset{|}{N}}-$$

wherein $R_8$ represents a hydrogen atom, an alkyl group having 5 or less carbon atoms, a substituted alkyl group having 5 or less carbon atoms (which may include as a substituent an alkoxy group having 3 or less carbon atoms, a cyano group, a hydroxyl group and an alkylamino group having 4 or less carbon atoms) or a bond.

Moreover, the more preferable compounds are represented by formula (I) wherein $m_1$ and $m_2$ represent 1. The most preferable compounds are represented by formula (I) where each of $R_1$ and $R_2$ represents an alkyl group, an aryl group, a cyano group, $-COOR_5$, $-CONR_5R_6$ and $-NR_6SO_2R_7$ under the above-mentioned conditions.

The following are concrete examples of compounds represented by formula (I), by which the scope of the present invention is not restricted.

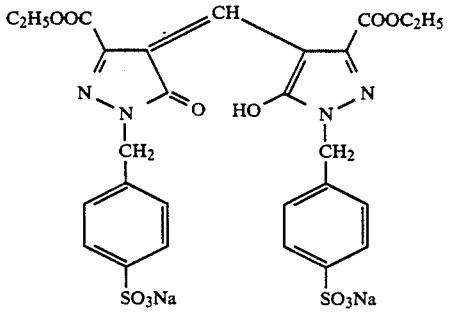

I-1

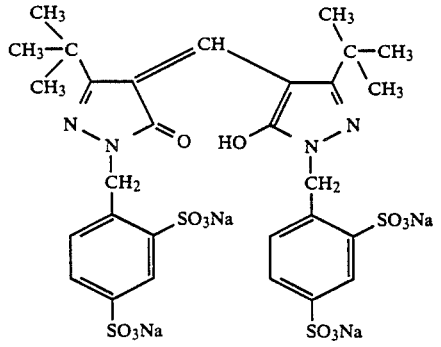

I-2

-continued
I-3
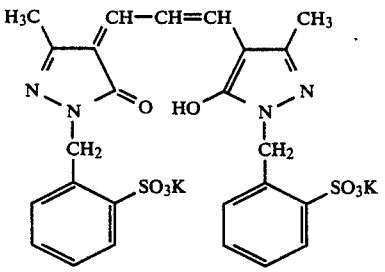
I-4
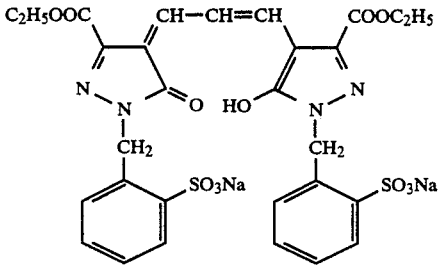
I-5
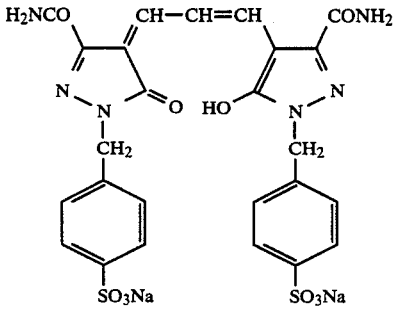
I-6
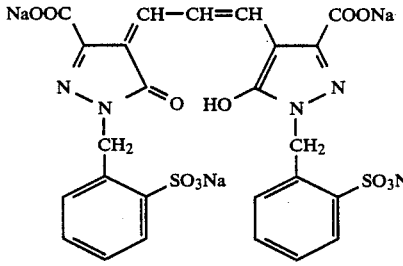
I-7
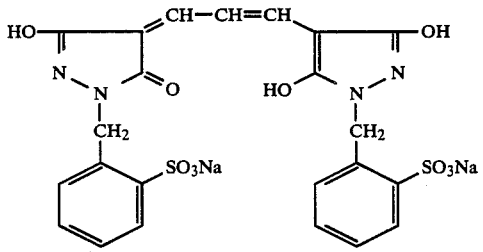
I-8
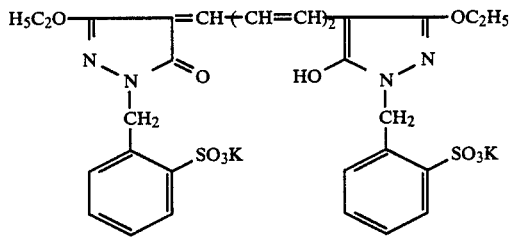

-continued
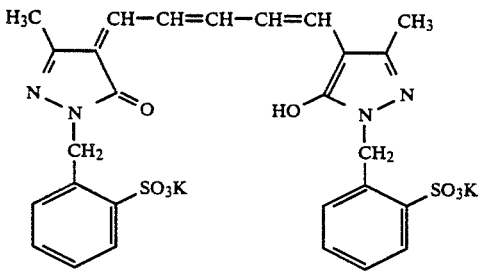
I-9
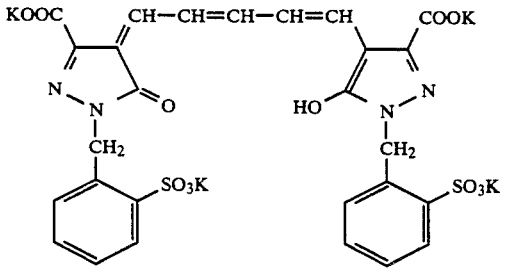
I-10
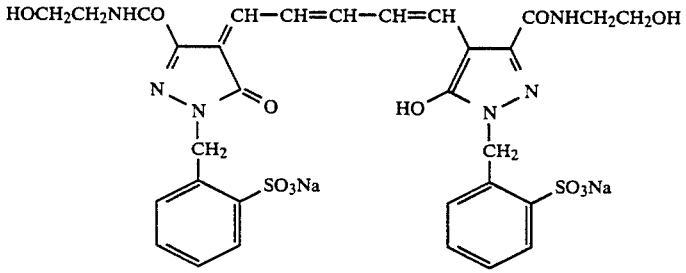
I-11
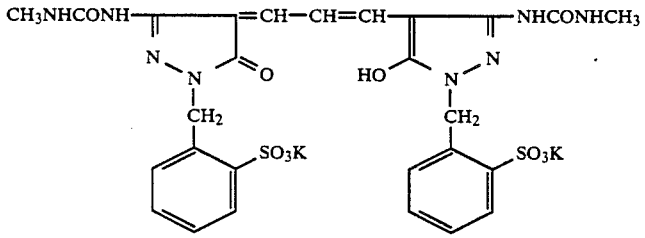
I-12
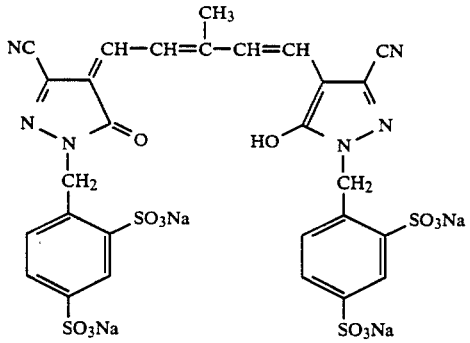
I-13

-continued
I-14
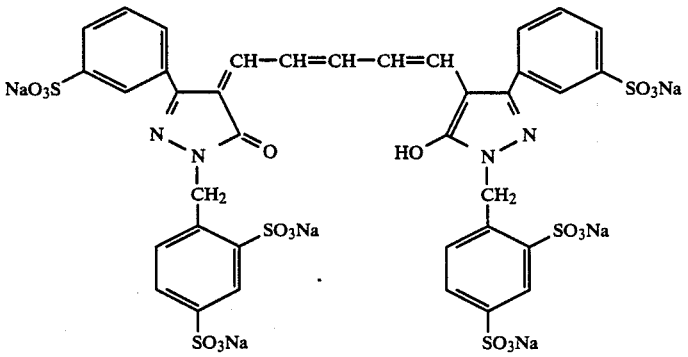
I-15
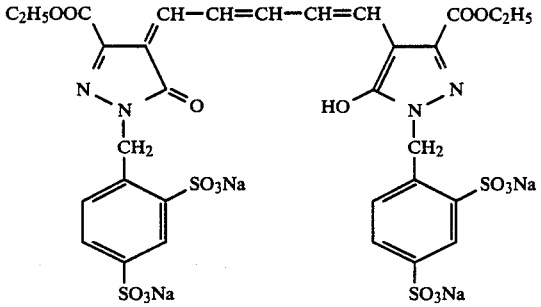
I-16
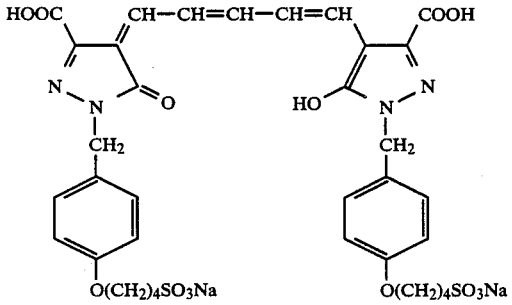
I-17
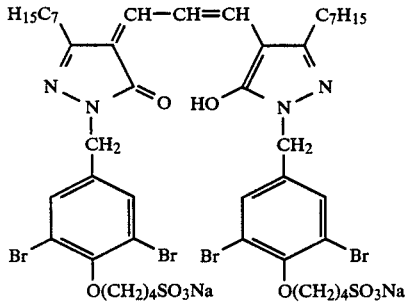
I-18
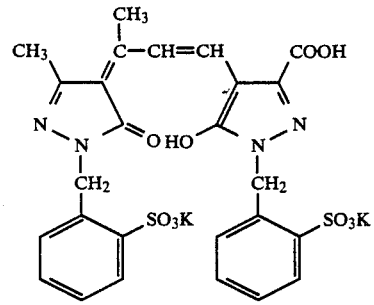

-continued
I-19
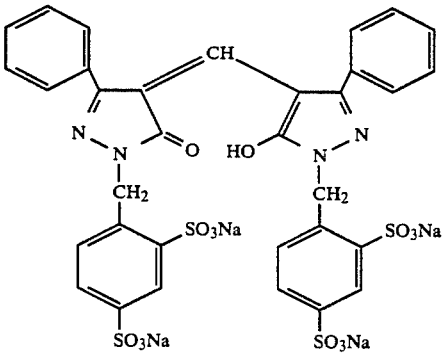
I-20
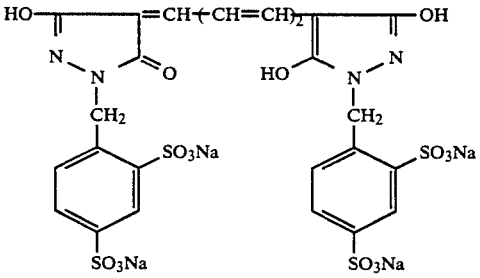
I-21
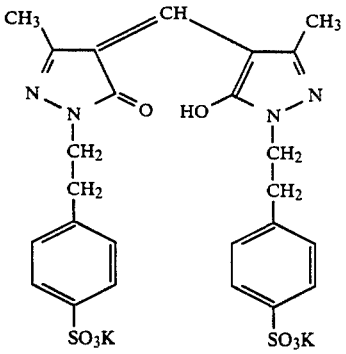
I-22
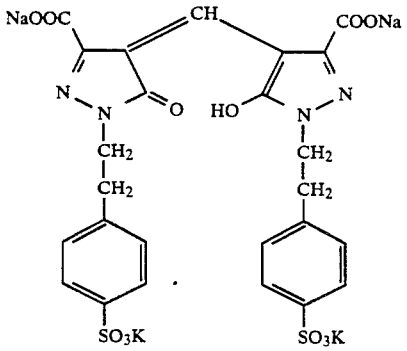

-continued
I-23
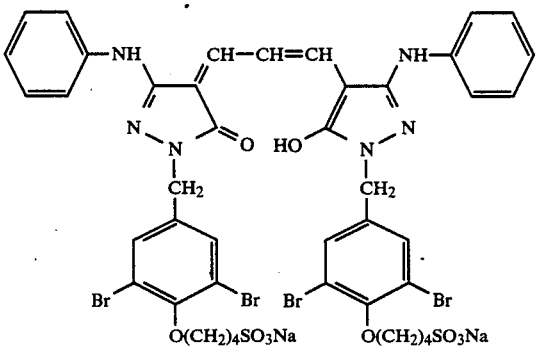
I-24
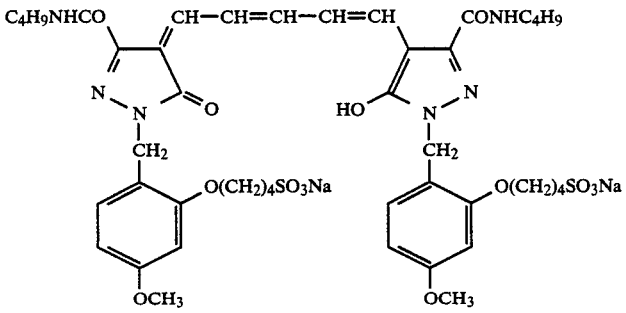
I-25
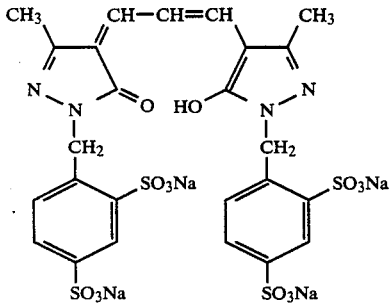
I-26
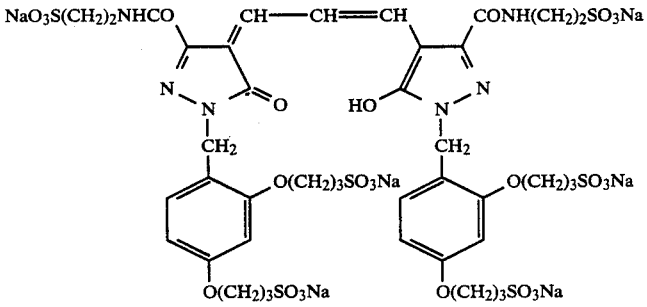
I-27
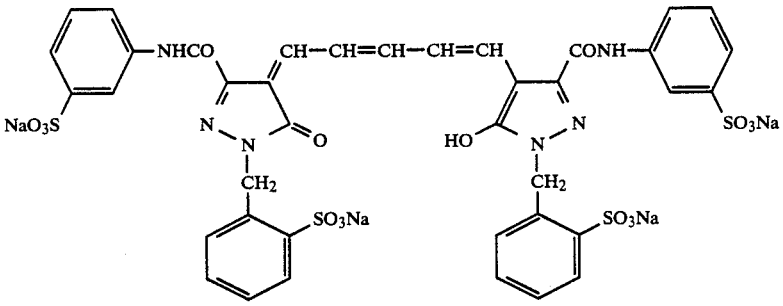

-continued
I-28
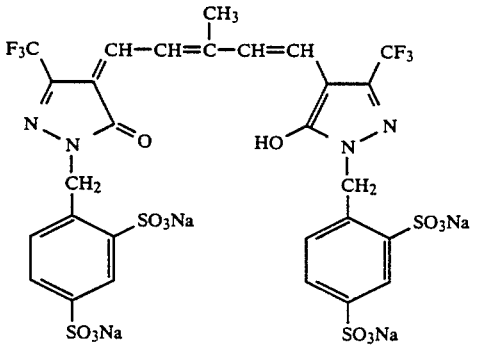
I-29
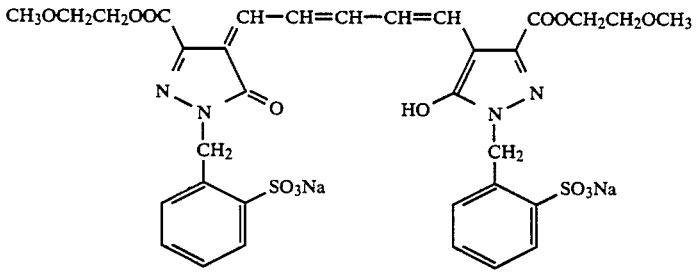
I-30
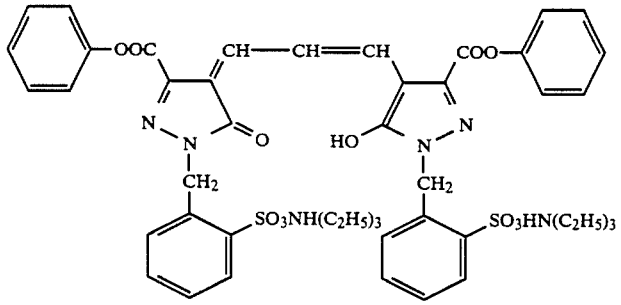
I-31
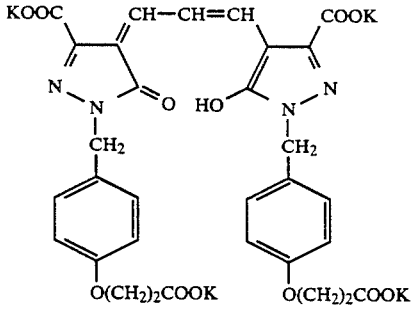
I-32
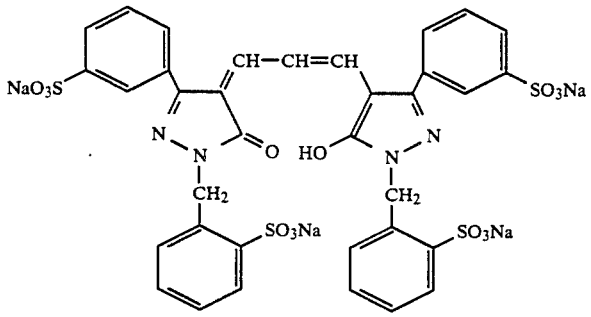

-continued
I-33
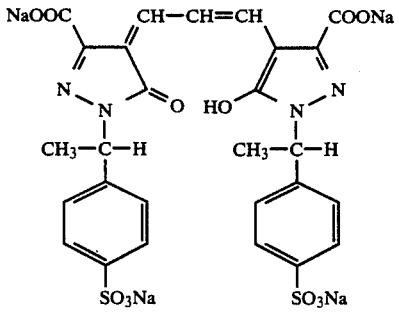
I-34
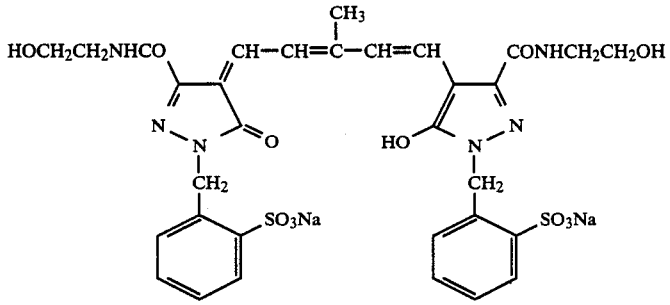
I-35
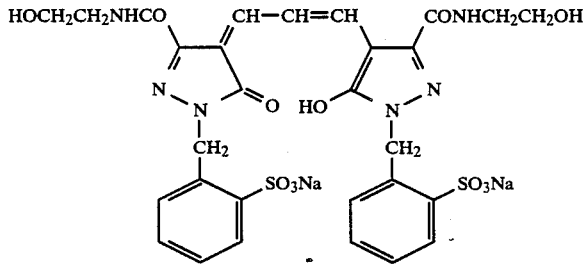
I-36
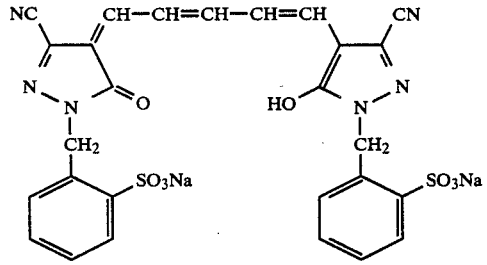
I-37
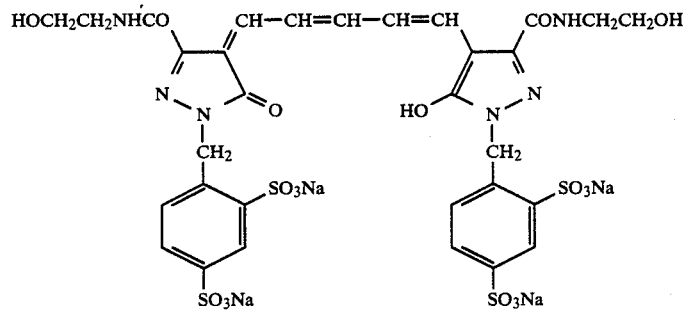

-continued
I-38
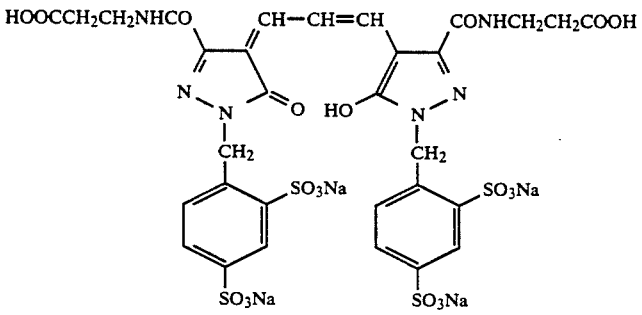
I-39
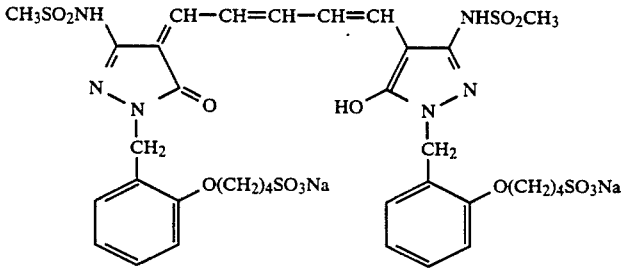
I-40
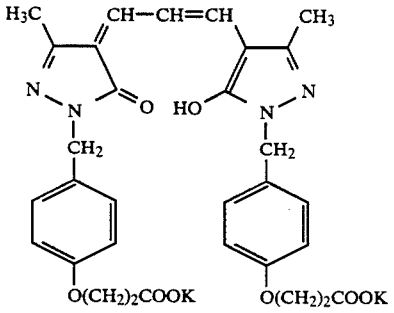
I-41
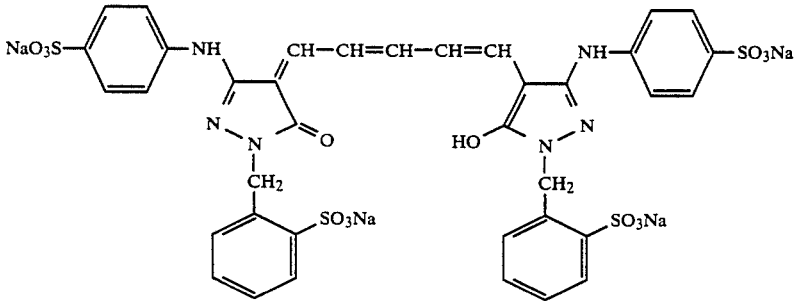
I-42
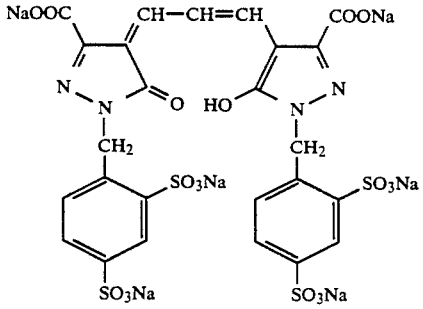

-continued
I-43
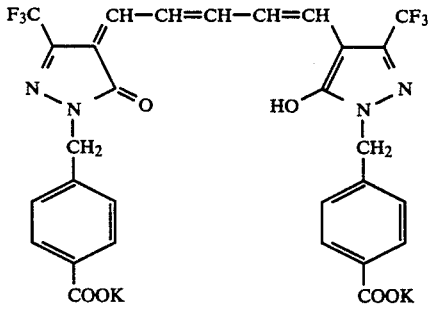
I-44
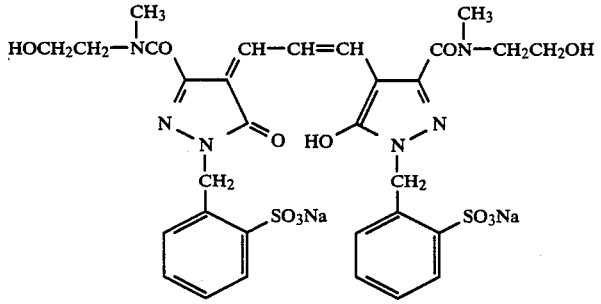
I-45
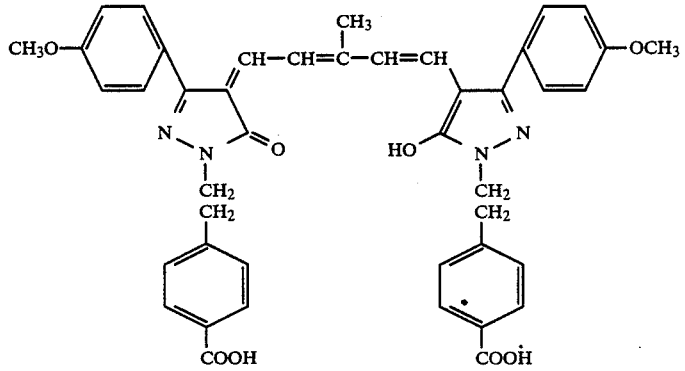
I-46
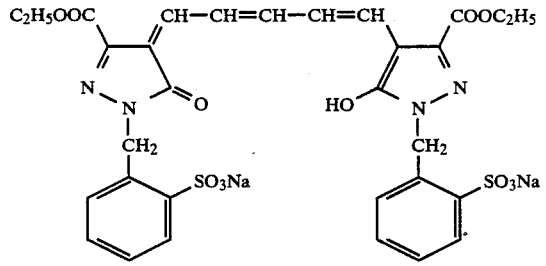
I-47
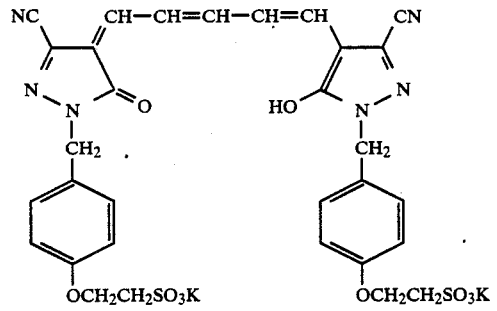

-continued

I-48

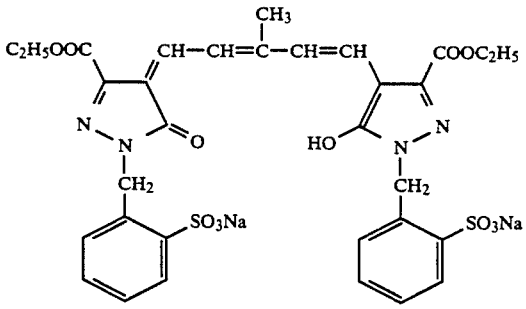

I-49

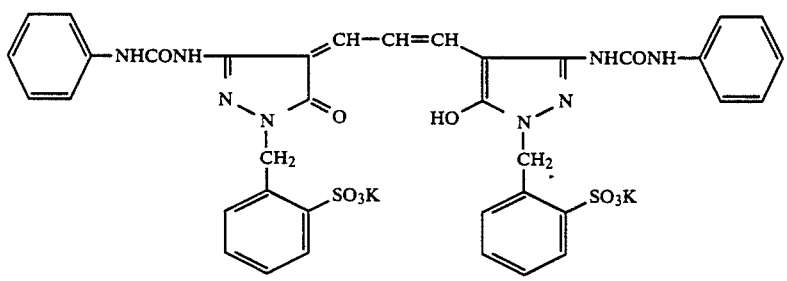

I-50

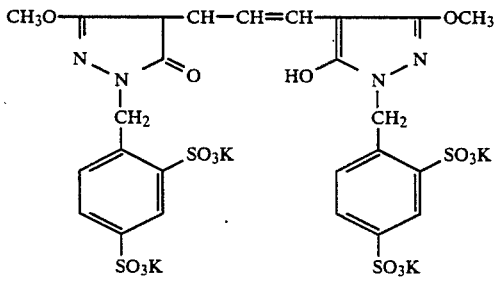

The dyes represented by formula (I) are disclosed in JP-A-50-145125, JP-A-50-147712, Japanese Patent Application Nos. 79483/87 and 110333/87 or can be synthesized in a manner similar to that described in the above disclosures.

The dyes represented by formula (I) to be used in the present invention are preferably used in amounts of 0.0003 to 0.5 g/m$^2$, particularly 0.001 to 0.2 g/m$^2$.

The dye according to the present invention may be dispersed into an emulsion layer or other hydrophilic colloid layer (e.g., an intermediate layer, a protective layer, an antihalation layer, and a filter layer) in various known ways.

(1) The dye for use in the present invention may be dissolved or dispersed in a fine solid state directly into an emulsion layer or a hydrophilic colloid layer, or it may first be dissolved or dispersed in a fine solid state into an aqueous solution or a solvent, and then used in an emulsion or hydrophilic colloid layer. The dye for use in the present invention may be dissolved in a suitable solvent such as methyl alcohol, ethyl alcohol, propyl alcohol, methyl cellosolve, halogenated alcohols described in JP-A-48-9715, and U.S. Pat. No. 3,756,830, acetone, water, and pyridine, and mixtures of these, and the solution may be added to an emulsion.

(2) A hydrophilic polymer having a charge opposite the dye ion is allowed to be present as a mordant in a layer, and by the interaction of the hydrophilic polymer with the dye molecule, the intended dye is permitted to be present locally in a specific layer.

As polymer mordants can be mentioned polymers having secondary and tertiary amino groups, polymers having nitrogen-containing heterocyclic moieties, and polymers having quaternary cation groups that have a molecular weight of 5,000 or over, particularly preferably 10,000 or over.

Examples are vinylpyridine polymers and vinylpyridinium cation polymers described, for example, in U.S. Pat. No. 2,548,564; vinylimidazolium cation polymers disclosed, for example, in U.S. Pat. No. 4,124,386; polymer mordants crosslinkable with gelatin or the like disclosed, for example, in U.S. Pat. No. 3,625,694; aqueous sol-type mordants disclosed, for example, in U.S. Pat. No. 3,958,995 and JP-A-54-115228; water-insoluble mordants disclosed in U.S. Pat. No. 3,898,088; reactive mordants capable of forming a covalent bond with dyes disclosed, for example, in U.S. Pat. No. 4,168,976; polymers derived from ethylenically-unsaturated compounds having a dialkylaminoalkyl ester residue as described in British Patent 685,475; products obtained by the reaction of polyvinyl alkyl ketones and aminoguanidine as disclosed in British Patent 850,281; and polymers derived from 2-methyl-1-vinylimidazole as described in U.S. Pat. No. 3,445,231.

(3) The compounds may be dissolved using a surface-active agent.

Useful surface-active agents may be oligomers or polymers.

Details of these polymers are described in JP-A-60-158437 (filed on Jan. 26, 1984 by Fuji Photo Film Co., Ltd.), pages 19 to 27.

To the hydrophilic colloid dispersion obtained as above may be added a hydrosol of a hydrophilic polymer described, for example, in JP-B-51-39835.

As hydrophilic colloids, gelatin is mentioned typically, though any of other hydrophilic colloids hitherto known for use in photography can be used.

Silver halide emulsions used in the present invention are preferably silver bromide, silver bromoiodide, silver bromochloroiodide, silver chlorobromide, and silver chloride.

In photographic material suitable for rapid processing, is one of preferable modes of the present invention, a so-called high silver chloride emulsion having a high silver chloride content is used. The silver chloride content of the high silver chloride emulsion is preferably 90 mol% or over, more preferably 95 mol% or over. The above-mentioned photographic material is preferably a color print photographic material.

The previously-not-fogged internal latent image type silver halide emulsions to be used in the present invention contain silver halide that forms a latent image mainly in the inside of the grains whose surfaces are not previously fogged. More specifically, a silver halide emulsion which, when coated on a treansparent support in a given amount (e.g., about 0.5~ about 3 g/m$^2$), exposed for a fixed time of about 0.01 to about 10 seconds, and developed at 18° C. for 5 minutes in the following developing solution A (an internal latent image type developing solution), gives a maximum density measured according to common method of measuring photographic density of at least 5 times, more preferably at least 10 times, as much as that when coated and exposed in the same manner and developed at 20° C. for 6 minutes in the following developing solution B (a surface latent image type developing solution) is preferable.

| Internal Latent Image-type Developing Solution A | |
|---|---|
| Metol | 2 g |
| Sodium sulfite (anhydrous) | 90 g |
| Hydroquinone | 8 g |
| Sodium carbonate (monohydrate) | 52.5 g |
| KBr | 5 g |
| KI | 0.5 g |
| Water to make | 1 liter |
| **Surface Latent Image-type Developing Solution B** | |
| Metol | 2.5 g |
| L-ascorbic acid | 10 g |
| $NaBO_2.4H_2O$ | 35 g |
| KBr | 1 g |
| Water to make | 1 liter |

As the internal latent image-type emulsions, there are, for example, conversion-type silver halide emulsions disclosed in U.S. Pat. No. 2,592,250, and core/shell type silver halide emulsions disclosed in U.S. Pat. Nos. 3,761,276; 3,850,637; 3,923,513; 4,035,185; 4,395,478; and 4,504,570; JP-A-52-156614, JP-A-55-127549, JP-A-53-60222, JP-A-56-22681, JP-A-59-208540, JP-A-60-107641, JP-A-61-3137, JP-A-62-215272, and the patents described in *Research Disclosure,* No. 23510 (November, 1983), page 236.

The silver halide to be used in the present invention may have various forms of regular crystals such as cubic crystals, octahedral crystals, dodecahedral crystals and tetradecahedral crystals; irregular crystals such as spherical crystals; and tabular grains having a length/thickness ratio of 5 or more. In addition, emulsions containing silver halide grains of composite form of these various crystal forms or containing a mixture of silver halide grains having different crystal forms may also be used.

As the silver halides, there are silver chloride, silver bromide, and mixtures thereof. The preferably employable silver halides of the present invention include silver chlorobromide, silver chloride or silver bromide each containing no silver iodide, or silver chloroiodobromide, silver iodochloride or silver iodobromide each containing 3 mol% or less of silver iodide.

The average grain size of silver halide grains is preferably in the range from about 0.1 μm to about 2 μm, most preferably from 0.15 μm and to 1 μm. The distribution of the grain size thereof may be broad or narrow, but the present invention preferably uses the so-called monodisperse silver halide emulsions which have such a narrow grain size distribution that more than 90% by weight or number of all the grains are included in the narrow range of average grain size ±40%, preferably ±20%, so as to improve graininess and sharpness. Also, a substantially the same color sensitive emulsion layer may include two or more different-grain-sized monodisperse silver halide emulsions or a plurality of the same-sized but different-sensitivity grains mixed in the same layer or applied separately in different layers in order to attain the desired gradation of the photosensitive materials. Moreover, two or more kinds of polydisperse silver halide emulsions or a combination of monodisperse and polydisperse emulsions in the form of a mixture or multilayers can be used.

The silver halide emulsions used in the present invention can be chemically sensitized in the inside or on the surface of the grains by means of sulfur or selenium sensitization, reduction sensitization and rare metal sensitization alone or in combinations thereof. Detailed embodiments are given, for example, in the patents described in *Research Disclosure,* No. 17643-III (December, 1978), p. 23.

The photographic emulsions used in the present invention are spectrally sensitized by an ordinary process using photographic sensitizing dyes. In particular, the most useful dyes include cyanine dyes, merocyanine dyes and composite merocyanine dyes, which can be used alone or in combination. Also, the above dyes can be used together with supersensitizers. Detailed embodiments are given, for example, in the patents described in *Research Disclosure,* No. 17643-IV (December, 1978), pp. 23 to 24.

The photographic emulsions used in the present invention can contain antifoggants or stabilizers to prevent photographic fogging of the photographic materials from occuring in the manufacturing process, during preservation or in the photographic processing, and to stabilize the photographic performance. Detailed embodiments are given, for example, in *Research Disclosure,* No. 17643-VI (December, 1978) and E. J. Birr, "Stabilization of Photographic Silver Halide Emulsion" (Focal Press), issued in 1974.

The photographic materials of the present invention can employ various color couplers. Color couplers are compounds which produce or release substantially-nondiffusing dyes by a coupling reaction with the oxidation products of aromatic primary amine color developing agents, and the color couplers themselves are preferably substantially nondiffusing ones.

Useful color couplers include naphthol or phenol compounds, pyrazolone or pyrazoloazole compounds and open-chained or heterocyclic ketomethylene compounds. Suitable cyan, magenta and yellow couplers for the present invention are given, for example in *Research Disclosure*, No. 17643 (December, 1978), p. 25, VII-D; ibid., No. 18717 (November, 1979); and JP-A-62-215272, the description of compounds and the cited patents.

Among these, typically employable yellow couplers of the present invention include oxygen atom releasing type- and nitrogen atom releasing type-yellow 2-equivalent couplers. In particular, α-pivaloyl acetoanilide couplers are excellent as to the fastness of formed dyes, particularly the light fastness thereof, while α-benzoylacetoanilide couplers are preferable because of giving high color density.

Also, preferably employable 5-pyrazolone magenta couplers in the present invention are the 5-pyrazolone couplers where the 3-position is substituted with an arylamino group or acylamino group (of these, the sulfur atom releasing type 2-equivalent couplers are the most preferable).

The more preferable ones are pyrazoloazole couplers. Among these, pyrazolo[5,1-c][1,2,4]triazoles described in U.S. Pat. No. 3,725,067 are more preferable; imidazo[1,2-b]pyrazoles described in U.S. Pat. No. 4,500,630 are much more preferable because of the small side absorption of yellow of the dyes formed and the good light fastness; and pyrazolo[1,2-b][1,2,4]triazole described in U.S. Pat. No. 4,540,654 is the most preferable.

Preferably employable cyan couplers in the present invention include naphthol and phenol couplers described in U.S. Pat. Nos. 2,474,293 and 4,502,212; phenol cyan couplers where the meta-position of the phenol nucleus has an alkyl group containing 2 or more carbon atoms described in U.S. Pat. No. 3,772,002; and also 2,5-diacylamino substituted phenol couplers because of good color image fastness.

There can be used colored couplers to correct the unwanted absorption in the short wavelength region of the formed colors, couplers having suitable diffusing properties of formed colors, colorless compound forming couplers, DIR couplers to release development inhibitors along with a coupling reaction, and polymerized couplers.

A color coupler is ordinarily used in an amount of about 0.001 to about 1 mol per 1 mol of photosensitive silver halide. Preferably, a yellow coupler is used in an amount of about 0.01 to about 0.5 mol, a magenta coupler in an amount of about 0.03 to about 0.5 mol and a cyan coupler in an amount of about 0.002 to about 0.5 mol per mol of photosensitive silver halide.

The present invention can employ coloration-intensifying agents to improve the coloring property of the couplers. Typically employable compounds are described in JP-A-62-215272, pp. 374 to 391.

The couplers of the present invention are dissolved in high-boiling and/or low boiling organic solvents and emulsified and dispersed in gelatin or other hydrophilic coloidal aqueous solutions by stirring at high speed using a homogenizer etc. by finely grinding with a machine such as a colloid mill or by the technique utilizing ultrasonic waves. The resulting coupler emulsions are added to emulsion layers. In this case, it is not always necessary to use high-boiling organic solvents, but it is preferable to use the compounds described in JP-A-62-215272, pp. 440 to 467.

The couplers of the present invention can be dispersed in hydrophilic colloids by the method described in JP-A-62-215272, pp. 468 to 475.

The photographic materials produced by the present invention may contain hydroquinone derivatives, aminophenol derivatives, amines, gallic acid derivatives, catechol derivatives, ascorbic acid derivatives, colorless compound forming couplers, and sulfonamide phenol derivatives as color antifoggants or color stain preventing agents. Typical examples of color antifiggants or color stain preventing agents are described in JP-A-62-215272.

The photographic materials of the present invention can employ various discoloration inhibitors. As the typical organic discoloration inhibitors, there are hydroquinones, 6-hydroxychromans, 5-hydroxycoumarans, spirochromans, p-alkoxyphenols, hindered phenols including bisphenols, gallic acid derivatives, methylenedioxybenzenes, aminophenols, hindered amines and ether or ester derivatives obtained by silylation or alkylation of the phenolic hydroxyl groups of each of the above compounds. Also, there can be used metal complexes such as (bissalicylaldoxymato)nickel complex and (bis-N,N-dialkyl-dithiocarbamato)nickel complex.

Typical discoloration inhibitors are described in JP-A-62-215272, pp. 401 to 440. The compounds are emulsified together with the corresponding respective color couplers ordinarily in an amount of from about 5 to about 100 wt% based on said coupler, and the resulting emulsions are added to photosensitive layers to obtain the aim.

In order to prevent the deterioration of cyan dye images due to heat and particularly light, it is effective to introduce ultraviolet ray absorbing agents into the two layers placed on both sides of the cyan dye forming layer. Also, the ultraviolet ray absorbing agents can be added to hydrophilic colloidal layers such as a protective layer. Typical compounds are described in JP-A-62-215272, pp. 391 to 400.

As binders or protective colloids to be used in the emulsion and intermediate layers of the photographic materials of the present invention, there are advantageously gelatin and other well known hydrophilic colloids.

The photographic materials of the present invention can contain ultraviolet ray absorbing agents, plasticisers, brightening agents, matting agents, air fog-preventing agents, coating aids, hardening agents, antistatic agents, and slipping properties-improving agents. These typical additives are described in *Research Disclosure*, No. 17643 VIII-XIII (December, 1978) pp. 25 to 27, ibid., No. 18716 (November, 1979) pp. 647 to 651.

The present invention can be applied to multi-layered multicolored photographic materials having at least two different spectral sensitivites. The multi-layered natural-color photographic materials have ordinarily at least one red-sensitive emulsion layer, at least one green-sensitive emulsion layer and at least one blue-sensitive emulsion layer on a support. These layers are arbitrarily arranged as desired. The favorable arrangement of the layers is in the order of a red-sensitive layer, a green-sensitive layer, and a blue-sensitive layer from the side of the support or a green-sensitive layer, a red-sensitive layer and a blue-sensitive layer from the side of the support. Also, each emulsion layer may consist of two or more different-sensitive emulsion layers or two or more same-color-sensitive emulsion layers with a photo-insensitive layer placed between the layers. The red-sensitive emulsion layers, the green-sensitive emulsion layers and the blue-sensitive emulsion layer usually contain a cyan-forming coupler, a magenta-forming coupler and a yellow-forming coupler, respectively, but, if desired, different combinations can be selected.

The following compounds can be added for the purpose of increasing the maximum image density, decreasing the minimum image density, improving the preservative property of photographic materials, or developing the materials quickly. Namely, there are hydroquinones (e.g., compounds described in U.S. Pat. Nos. 3,227,552 and 4,279,987); chromans (e.g., compounds described in U.S. Pat. No. 4,268,621; JP-A-54-103031; *Research Disclosure,* No. 18264 (June, 1979), pp. 333 to 334); quinones (e.g., compounds described in *Research Disclosure,* No. 21206 (December, 1981), pp. 433 to 434); amines (e.g., compounds described in U.S. Pat. No. 4,150,993 and JP-A-58-174757); oxidizing agents (e.g., compounds described in JP-A-60-260036, *Research Disclosure,* No. 16936 (May, 1978), pp. 10 to 11); catechols (e.g., compounds described in JP-A-55-21013 and JP-A-55-65944); compounds to release nucleating agents when developed (e.g., compounds described in JP-A-60-107029); thioureas (e.g., compounds described in JP-A-60-95533); and spirobisindenes (e.g., compounds described in JP-A-55-65944).

It is preferable that the photographic materials of the present invention can suitably include auxiliary layers such as a protective layer, intermediate layers, filter layers, an antihalation layer, a back layer and a white reflecting layer in addition to silver halide emulsion layers.

In the photographic materials of the present invention, the photographic emulsion layers and other layers are applied on the supports as described in *Research Disclosure,* No. 17643 XVII (December, 1978), p. 28; European Patent 0,182,253; and JP-A-61-97655. Also, the method of application described in *Research Disclosure,* No. 17643 XV, pp. 28 and 29 can be utilized in the present invention.

The color photosensitive materials of the present invention can be used in various ways.

As typical examples, there are color reversal film for slides or television, color reversal paper, and instant color film. Moreover, the same can be used in color hard copies for preserving the images of full-color photocopiers and CRT. Also, the present invention can be used in black-and-white photosensitive materials utilizing a three color coupler mixture as described in *Research Disclosure,* No. 17123 (July, 1978).

Furthermore, the present invention can be used in black-and-white photographic materials.

As the black-and-white (B/W) photographic materials to be used in the present invention, there are B/W direct positive photosensitive materials (e.g., X-ray photosensitive materials, duplicating photosensitive materials, microphotosensitive materials, photographic materials, printing photosensitive materials) described in JP-A-59-208540 and JP-A-60-260039.

The photographic materials of the present invention can be used to form direct positive color images by carrying out the development treatment with a surface developing solution containing an aromatic primary amine color developing agent and the bleach and fixing treatments after or while conducting the fog-treatment with light or a nucleating agent after achieving the imagewise exposure.

The fogging treatment of the present invention may be conducted by any one of the so-called "light fogging process" for giving the second layer on the whole surface of the photosensitive layer as mentioned above and the so-called "chemically fogging process" for developing in the presence of a nucleating agent. The development may be carried out in the presence of a nucleating agent and fogging light. Also, the photographic materials containing nucleating agents may be exposed to fogging light.

The uniform exposure, that is, the fogging exposure in the "light-fogging process" of the present invention is carried out before and/or during development after carrying out the imagewise exposure. The imagewise exposed photographic materials are exposed to light while immersed in a developing solution or a prebath of the developing solution, or after taken out from the solutions and before being dried. Exposure within the developing solution is the most preferable.

The light sources for fogging-exposure should have any light-wavelengths in the range of light-sensitive wavelengths of the photographic materials. In general, there can be used a fluorescent lamp, a tungsten lamp, a xenon lamp and sunlight. Concrete processes are described, for example, in British Patent 1,151,363, JP-B-45-12710, JP-B-45-12709, JP-B-58-6936, JP-A-48-9727, JP-A-56-137350, JP-A-57-129438, JP-A-58-62652, JP-A-53-60739, JP-A-58-70223 (the corresponding U.S. Pat. No. 4,440,851), and JP-A-58-120248 (the corresponding European Patent 890101A2).

The photosensitive materials having sensitivities to the whole wavelength range such as color photosensitive materials preferably employ the high color-rendering light sources (nearly white) as described in JP-A-56-137350 and JP-A-58-70223. The suitable light illuminance is in the range of about 0.01 to about 2000 lux, preferably about 0.05 to about 30 lux, more preferably 0.05 to 5 lux. The photosensitive materials using the more high-sensitive emulsions can preferably have the lower illuminance exposure. The adjustment of illuminance may be conducted by changing the luminous intensity of a light source, decreasing the intensity of light with various filters, or altering the distance or angle between the photosensitive materials and a light source. The exposure time can be shortended by using a lower degree of light at the beginning of exposure and then using a higher degree of light.

The photographic materials are preferably soaked in a developing solution or a prebath thereof until the solution sufficiently penetrates into the emulsion layers of the photographic materials and then are exposed to light. The time from soaking to light fogging exposure is generally from about 2 seconds to about 2 minutes, preferably from about 5 seconds to about 1 minute, more preferably from 10 seconds to 30 seconds.

The fogging exposure time is generally from about 0.01 second to about 2 minutes, preferably from about 0.1 second to about 1 minute, more preferably from 1 second to 40 seconds.

Past compounds developed in view of the nucleation of infternal latent image type silver halides can be used as nucleating agents in the present invention. Combinations of two or more types of nucleating agents may also be used. These substances are disclosed on pages 50–54 of *Research Disclosure* No. 22534 (January, 1983), pages 76–77 of *Research Disclosure* No. 15162 (November 1976) and pages 346–352 of *Research Disclosure* No. 23510 (November, 1983). Further, they can be classified broadly into three types, namely quaternary heterocyclic compounds (compounds which can be represented by the following general formula (N-I), hydrazine based compounds (compounds which can be represented by the following general formula (N-II), and other compounds.

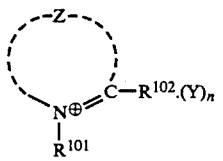

(N-I)

Z represents a group of non-metallic atoms which are required to form a 5 or 6-membered heterocyclic ring such as a quinoline ring, a benzothiazole ring, a 1,2,3,4-tetrahydroacridine ring, a 2,3-pentamethylenequinoline ring, and a pyridine ring, and Z may be substituted with substituents.

Examples of the substituents include a nitro group, a halogen atom (e.g., Cl, Br), a mercapto group, a cyano group, a substituted or unsubstituted alkyl group (e.f., ethyl, methyl, propyl, tert-butyl, cyanoethyl), an aryl group (e.g., phenyl, 4-methanesulfonamidophenyl, 4-methylphenyl, 3,4-dichlorophenyl, naphthyl), an alkenyl group (e.g., allyl), an aralkyl group (e.g., benzyl, 4-methylbenzyl, phenethyl), a sulfonyl group (e.g., methanesulfonyl, ethanesulfonyl, p-toluenesulfonyl), a carbamoyl group (e.g., unsubstituted carbamoyl, methylcarbamoyl, phenylcarbamoyl), a sulfamoyl group (e.g., unsubstituted sulfamoyl, methylsulfamoyl, phenylsulfamoyl), a carbonamido group (e.g., acetamido, benzamido), a sulfonamido group (e.g., methanesulfonamido, benzenesulfonamido, p-toluenesulfonamido), an acyloxy group (e.g., acetoxyl, benzoyloxyl), a sulfonyloxyl group (e.g., methanesulfonyloxyl), a ureido group (e.g., unsubstituted ureido, methylureido, ethylureido, phenylureido), a thioureido group (e.g., unsubstituted thioureido, methylureido), an acyl group (e.g., acetyl, benzoyl), a hydroxycarbonyl group (e.g., methoxycarbonyl, phenoxycarbonyl), a hydroxycarbonylamino group (e.g., methoxycarbonylamino, phenoxycarbonylamino, 2-ethylhexyloxycarbonylamino), a carboxylic acid or a salt thereof, a sulfonic acid or a salt thereof, and a hydroxyl group.

$R^{101}$ is an aliphatic group and $R^{102}$ is a hydrogen atom, an aliphatic group or an aromatic group. $R^{101}$ and $R^{102}$ may be substituted with substituents. Furthermore, $R^{102}$ and Z may be joined together to form a ring. However, at least one of the groups represented by $R^{101}$, $R^{102}$ and Z represents an alkinyl group, an acyl group, a hydrazine group or a hydrazone group, or $R^{101}$ and $R^{102}$ form a 6-membered ring and a dihydropyridinum skeleton is formed. Moreover, at least one of the substituents of $R^{101}$, $R^{102}$ and Z may have an $X^1$—$(L^1)_m$— group. Here $X^1$ is a group which promotes adsorption on silver halide, and $L^1$ is a divalent linking group. Y is a counter ion for balancing the electrical charge, n is 0 or 1 and m is 0 or 1.

Specific examples of compounds which can be represented by general formula (N-I) are given below.

(N-I-1) 5-Ethoxy-2-methyl-1-propargylquinolinium bromide
(N-I-2) 2,4-Dimethyl-1-propargylquinolinium bromide
(N-I-3) 2-Methyl-1-{3-[2-(4-methylphenyl)hydrazono]-butyl}quinolinium iodide
(N-I-4) 3,4-Dimethyldihydropyrrolido[2,1-b]benzothiazolium bromide
(N-I-5) 6-Ethoxythiocarbonylamino-2-methyl-1-propargylquinolimium trifluoromethanesulfonate
(N-I-6) 2-Methyl-6-(3-phenylthioureido)-1-propargylquinolinium bromide
(N-I-7) 6-(5-Benzotriazolecarboxamido)-2-methyl-1-propargylquinolinium trifluoromethanesulfonate
(N-I-8) 6-[3-(2-Mercaptoethyl)ureido]-2-methyl-1-propargylquinolinium trifluoromethanesulfonate
(N-I-9) 6-{3-[3-(5-mercapto-1,3,4-thiadiazol-2-ylthio)-propyl]lureido}-2-methuyl-1-propargylquinolinium trifluoromethanesulfonate
(N-I-10) 6-(5-Mercaptotetrazol-1-yl)-2-methyl-1-propargylquinolinium iodide
(N-I-11) 1-Propargyl-2-(1-propenyl)quinolinium trifluoromethanesulfonate
(N-I-12) 6-Ethoxythiocarbonylamino-2-(2-methyl-1-propenyl)-1-propargylquinolinium trifluoromethanesulfonate
(N-I-13) 10-Propargyl-1,2,3,4-tetrahydroacridinium trifluoromethanesulfonate
(N-I-14) 7-Ethoxythiocarbonylamino-10-propargyl-1,2,3,4-tetrahydroacridinium trifluoromethanesulfonate
(N-I-15) 6-Ethoxythiocarbonylamino-1-propargyl-2,3-pentamethylenequinolinium trifluoromethanesulfonate
(N-I-16) 7-[3-(5-Mercaptotetrazol-1-yl)benzamido]-10-propargyl-1,2,3,4-tetrahydroacridinium perchlorate
(N-I-17) 6-[3-(5-Mercaptotetrazol-1-yl)benzamido]-1-propargyl-2,3-pentamethylenequinolinium bromide
(N-I-18) 7-(5-Mercaptotetrazol-1-yl)-9-methyl-10-propargyl-1,2,3,4-tetrahydroacridinium bromide
(N-I-19) 7-[3-[N-[2-(5-mercapto-1,2,4-thiadiazol-2-yl)thioethyl]carbamoyl}propaneamido]-10-propargyl-1,2,3,4-tetrahydroacridinium tetrafluoroborate
(N-I-20) 6-(5-Mercaptotetrazol-1-yl)-4-methyl-1-propargyl-2,3-pentamethylenequinolinium bromide
(N-I-21) 7-Ethoxythiocarbonylamido-10-propargyl-1,2-dihydroacridinium trifluoromethanesulfonate
(N-I-22) 7-(5-Mercaptotetrazol-1-yl)-9-methyl-10-propargyl-1,2-dihydroacridinium hexafulorophosphate
(N-I-23) 7-[3-(5-Mercaptotetrazol-1-yl)benzamido]-10-propargyl-1,2-dihydroacridinium bromide

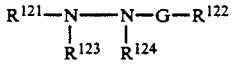

(N-II)

$R^{121}$ represents an aliphatic group, an aromatic group or a heterocyclic group, $R^{122}$ represents a hydrogen atom, an alkyl group, an aralkyl group, an aryl group, an alkoxy group, an aryloxy group or an amino group, G represents a carbonyl group, a sulfonyl group, a sulfoxy group, a phosphoryl group or an iminomethylene group (NH=C<), and $R^{123}$ and $R^{124}$ both represent hydrogen atoms or one represents a hydrogen atom and the other represents an alkylsulfonyl group, an arylsulfonyl group or an acyl group. Furthermore, a hydrazone structure (>N—N=C<) may be formed containing G, $R^{122}$, $R^{124}$ and the hydrazine nitrogen. Further, the groups mentioned above can, where possible, be substituted with substituents.

Specific examples of compunds which can be represented by general formula (N-II) are given below.

(N-II-1) 1-Formyl-2-{4-[3-(2-methoxyphenyl)ureido]-phenyl}hydrazine (N-II-2) 1-Formyl-2-{4-[3-{3-[3-(2,4-di-tert-pentylphenoxy)propyl]ureido}phenylsulfonylamino]-phenyl}hydrazine (N-II-3) 1-Formyl-2-{4-[3-(5-mercaptotetrazol-1-yl)benzamido]phenyl}hydrazine (N-II-4) 1-Formyl-2-[4-{3-[3-(5-mercaptotetrazol-1-yl)phenyl]ureido}hydrazine (N-II-5) 1-Formyl-2-[4-{3-[N-(5-mercapto-4-methyl-1,2,4-triazol-3-yl)carbamoyl)propaneamido}phenyl]-hydrazine (N-II-6) 1-Formyl-2-{4-[3-{N-[4-(3-mercapto-1,2,4-triazol-4-yl)phenyl]carbamoyl}propaneamido]-phenyl}hydrazine (N-II-7) 1-Formyl-2-[4-{3-[N-(5-mercapto-1,3,4-thiadiazol-2-yl)carbamoyl]propaneamido}phenyl]hydrazine (N-II-8) 2-[4-benzotriazol-5-carboxamido)phenyl]-1-formylhydrazine (N-II-9) 2-[4-{3-(N-(benzotriazol-5-carboxamido)carbamoyl]propaneamido}phenyl-1-formylhydrazine (N-II-10) 1-Formyl-2-{4-[1-[N-phenylcarbamoyl)thiosemicarbamido]phenyl}hydrazine (N-II-11) 1-Formyl-2-{4-[3-(3-phenylthioureido)benzamido]phenyl}hydrazine (N-II-12) 1-Formyl-2-[4-(3-hexylureido)phenyl]hydrazine (N-II-13) 1-Formyl-2-{4-[3-(5-mercaptotetrazol-1-yl)benzenesulfonamido]phenyl}hydrazine (N-II-14) 1-Formyl-2-{4-[3-{3-[3-(5-mercaptotetrazol-1-yl)phenyl]ureido}benzesulfonamido]phenyl}hydrazine.

The nucleating agents used in the present invention can be included in the photographic material or in the processing bath for the photographic material. However, they are preferably included in the photographic material.

When the nucleating agents are included in the photographic material the amount used is preferably within the range from $10^{-8}$ to $10^{-2}$ mol, and more desirably within the range from $10^{-7}$ to $10^{-3}$ mol, per mol of silver halide. Other useful hydrazine based nucleating agents have been disclosed in JP-A-57-86829 and U.S. Pat. Nos. 4,560,638, 4,478,928, 2,563,785 and 2,588,982.

Further, in cases where the nucleating agent is added to the development bath, the amount used of the nucleating agent is preferably from $10^{-8}$ to $10^{-3}$ mol, and most desirably from $10^{-7}$ to $10^{-4}$ mol, per liter.

Employable nucleation accelerators of the present invention are described in JP-A-63-106656, pp. 5 to 16. The following are examples of compounds to be used as the nucleation accelerators.

(A-1) 3-mercapto-1,2,4-triazolo[4,5-a]pyridine (A2) 3-mercapto-1,2,4-triazolo[4,5-a]pyrimidine (A-3) 5-mercapto-1,2,4-triazolo[1,5-a]pyrimidine (A-4) 7-(2-dimethylaminoethyl)-5-mercapto-1,2,4-triazolo[1,5-a]pyrimidine (A-5) 3-mercapto-7-methyl-1,2,4-triazolo[4,5-a]pyrimidine (A-6) 3,6-dimercapto-1,2,4-triazolo[4,5-b]pyridazine (A-7) 2-mercapto-5-methylthio-1,3,4-thiadiazole (A-8) 3-mercapto-4-methyl-1,2,4-triazole (A-9) 2-(3-dimethylaminopropylthio)-5-mercapto-1,3,4-thiadiazole hydrochloride (A-10) 2-(2-morpholinoethylthio)-5-mercapto-1,3,4-thiadiazole hydrochloride.

The color developing solution to be used for the development of the photographic materials of the present invention is preferably an alkaline aqueous solution consisting chiefly of an aromatic primary amine color developing agent. As the color developing agents, aminophenolic compounds are also useful, but p-phenylenediamine compounds are preferably used. As the typical p-phenylenediamine compounds, there are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and sulfates, hydrochlorides or p-toluenesulfonates thereof. Two or more of these compounds can be used together if desired.

In general, color developing solutions contain pH buffers such as a carbonate, borate or phosphate of alkali metals, development inhibitors or antifoggants such as bromides, iodides, benzimidazoles, benzothiazoles, and mercapto compounds.

In general, these color developing solutions have a pH of 9 to 12, preferably 9.5 to 11.5. The replenished amounts of these developing solutions, depending on the color photographic materials to be treated, are at most 1 liter per 1 $m^2$ of the photographic materials and also can be decreased to 300 ml or less by lowering the ion concentration of bromide included in replenishing solutions. When the replenished amounts are decreased, it is preferable to prevent the evaporation of the solutions and the air oxidation thereof by decreasing the air-contact area of the treating tank. Also, the replenished amounts can be decreased by means of restraining the accumulation of silver bromide ions in the developing solutions.

The photographic emulsion layers are usually bleached after the color development. The bleach treatment may be carried out simultaneously with fix treatment (bleach-fix treatment), or may be carried out independently. Moreover, in order to speed up the processing, a bleach-fix treatment may be conducted after bleach treatment. Further, the photographic emulsion layers may be treated continuously in two tanks of bleach-fix baths, fixed before bleach-fix treatment or bleached after bleach-fix treatment, if desired. As the bleaching agents, there can be used, for example, compounds of polyvalent metals such as iron(III), cobalt(III), chromium(VI), and copper(II), peroxides, quinones, and nitro compounds. As the typical bleaching agents, there are ferricyanides; dichromates; organic complex salts of iron(III) or cobalt(III), e.g., complex salts of aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, and glycoletherdiaminetetraacetic acid, or complex salts of citric acid, tartaric acid, and malic acid; persulfates; bromates; permanganates; and nitrobenzenes. Of these, the aminopolycarboxylic acid iron(III) complexes such as ethylenediamine tetraacetic acid iron(III) complex etc. and persulfates are preferable in view of rapid processing and the prevention of environmental pollution. Moreover, the aminopolycarboxylic acid iron(III) complexes are particularly useful both in a bleaching solution and in a bleach-fix bath. The aminopolycarboxylic acid iron(III) complex-containing bleaching solution or bleach-fix bath usually has a pH of 5.5 to 8. The lower pH is allowable for the purpose of speeding up the processing.

The bleaching solution, the bleach-fix bath and the prebath thereof can employ bleach accelerators, if desired.

As the fixing agents, there are thiosulfates, thiocyanates, thioether compounds, thioureas and a large amount of iodides. Thiosulfates are usually used, and particularly ammonium thiosulfate can most widely be used. As the preservatives of the bleach-fix bath, there are preferably used sulfite and hydrogensulfite or carbonyl hydrogenesulfite adducts.

In washing or stabilizing baths, softened water is preferably used. As the water-softening method, there is the use of an ion exchange resin or back permeation device.

The washing bath means the bath used chiefly for the purpose of washing out of the treating solution components attached to or adsorbed to color photographic materials and the constituents of the color photographic materials to be removed to keep the photographic performance and image stability after treatment.

Also, the stabilizing bath, although including the function of the washing bath, means the bath provided with the image-stabilizing function which cannot be obtained by the mere washing bath, for example, a bath containing formalin.

The amount of the prebath introduced into the washing bath means the volume of the prebath mixed into the water washing bath along with the photographic materials by being attached and adsorbed thereto, which can be calculated by extracting the prebath components from the color photographic materials taken out and immersed in water before being placed in the water washing bath, and determining the amounts of the prebath components in the extracted solution.

In the present invention, the replenished amount of the water washing bath or the alternative stabilizing bath is 350 ml or less per 1 $m^2$ of the color photographic materials to be treated, preferably 90 to 350 ml, more preferably 120 to 290 ml. Also, the water washing or stablizing bath has a pH of 4 to 10, preferably 5 to 9, more preferably 6.5 to 8.5.

In general, the washing process employs two or more tanks of multistage countercurrent washing (e.g., 2 to 9 tanks) to reduce the amount of washing water. Moreover, such a multistage countercurrent stabilizing process as described in JP-A-57-8543 may be carried out in place of the washing process.

The washing and stabilizing time of the present invention, depending on the kinds and processing conditions of the photographic materials, is usually in the range of from 20 seconds to 10 minutes, preferably 20 seconds to 3 minutes, more preferably 30 seconds to 2.5 minutes.

The various processing solutions can be used at a temperature of 10° C. to 50° C., usually 28° C. to 38° C. The higher temperature can promote the processing to shorten the time while the lower temperature can improve the image quality and the stability of the processing solutions.

On the other hand, in order to develop black-and-white photographic materials, there are used various known developing agents, for example, polyhydroxybenzenes such as hydroquinone, 2-chlorohydroquinone, 2-methylhydroquinone, catechol, pyrogallol; aminophenols such as p-aminophenol, N-methyl-p-aminophenol, 2,4-diaminophenol; 3-pyrazolidones such as 1-phenyl-3-pyrazolidones, 1-phenyl-4,4'-dimethyl-3-pyrazolidone, 1-phenyl-4-methyl-4-hydroxmethyl-3-pyrazolidone, 5,5-dimethyl-1-phenyl-3-pyrazolidone; and ascorbic acids alone or in combination.

A detailed description of developing agents, preservatives, buffers and developing methods of black-and-white photographic materials is given in *Research Disclosure,* No. 17643 (December, 1978) XIX to XXI.

The present invention will be illustrated in more detail by the following Examples, but is not restricted thereby.

Unless otherwise indicated, all perents, ratios, parts, etc. are by weight.

EXAMPLE 1

(1) Production of Emulsion

Emulsion A was prepared by the following process.

Emulsion A

An aqueous solution of potassium bromide and an aqueous solution of silver nitrate were simultaneously added to an aqueous solution of gelatin containing 0.27 g of 3,4-dimethyl-1,3-thiazoline-2-thione per 1 mol of Ag with vigorous stirring at 75° C. in 7 minutes to obtain an octahedron monodisperse silver bromide emulsion having an average grain size of 0.3 μm. To the resulting emulsion were added 47 mg of sodium thiosulfate and 47 mg of chloroauric acid (tetrahydrate) per 1 mol of Ag, and the mixture was heated at 75° C. for 80 minutes to achieve chemical sensitization thereof. The thus obtained silver bromide grains were processed as cores in the same precipitation circumstance as the first process further for 40 minutes to be grown more to finally obtain an octahedron monodisperse core/shell silver bromide emulsion having an average grain size of 0.65 μm (coefficeint of variation 11%). After washing and desalting this emulsion, 3.1 mg of sodium thiosulfate and 3.1 mg of chloroauric acid (tetrahydrate) were added to the emulsion and the mixture was heated at 60° C. for 60 minutes to achieve chemical sensitization thereof and to obtain an internal latent image type silver halide emulsion A.

The core/shell type internal latent image emulsion A was used to produce multilayered color printing paper having the layer structure shown in table below on a 100 μm-thick paper support laminated with polyethylene on both sides thereof. The coating solutions were prepared in the following manner.

Preparation of the first coating solution

To 6.4 g of cyan coupler (a) and 2.3 g of color image stabilizer (b) were added 10 ml of ethyl acetate and 4 ml of solvent (c), and the mixture was dissolved. This solution was emulsified and dispersed in 90 ml of a 10% gelatin aqueous solution containing 5 ml of 10% sodium dodecylbenzesulfonate. On the other hand, to the silver halide emulsion (70 g/kg of Ag present) was added the red-sensitive dye shown below in an amount of $2.0\times10^{-4}$ mol per 1 mol of silver halide to obtain 90 g of the red-sensitive emulsion. The emulsified dispersion, the emulsion and a development accelerator (d) were mixed and dissolved to give the composition as shown below by adjusting the concentration with gelatin, and further $4\times10^{-5}$ mol of a nucleating agent and $5\times10^{-4}$ mol of a nucleation accelerator per 1 mol of Ag were added to obtain the first layer coating solution.

The second to seventh layer coating solutions were prepared in a manner similar to the first layer coating solution except that for the green-sensitive layer the green-sensitive dye shown below was used and for the blue-sensitive layer the blue-sensitive dye shown below was used. As the gelatin hardening agent of each layer 1-oxy-3,5-dichloro-s-triazine sodium salt was used.

The following dyes were used as the spectral sensitizer for each emulsion. There was used 4 mg/m$^2$ of 4-hydroxy-6-methyl-1,3,3a,7-tetrazaindene in each emulsion layer.

Specimen 101 was prepared having the following layer unstitution.

| Layer | Principle Components | Amount |
|---|---|---|
| The 7th layer (protective layer) | Gelatin | 1.33 g/m$^2$ |
| | Latex grain of polymethyl methacrylate (average grain size of 2.8 μm) | 0.05 g/m$^2$ |
| | Acryl-denatured copolymer of polyvinyl alcohol (denaturation degree 17%) | 0.17 g/m$^2$ |
| The 6th layer (ultraviolet ray adsorbing layer) | Gelatin | 0.54 g/m$^2$ |
| | Ultraviolet ray absorbing agent (i) | 5.10 × 10$^{-4}$ mol/m$^2$ |
| | Solvent (k) | 0.08 g/m$^2$ |
| The 5th layer (blue-sensitive layer) | Emulsion silver; | 0.40 g/m$^2$ |
| | Gelatin | 1.35 g/m$^2$ |
| | Yellow coupler (l) | 6.91 × 10$^{-4}$ mol/m$^2$ |
| | Dye stabilizer (m) | 0.13 g/m$^2$ |
| | Solvent (h) | 0.02 g/m$^2$ |
| | Development accelerator (d) | 32 mg/m$^2$ |
| | Nucleating agent and nucleation accelerator | |
| The 4th layer (ultraviolet ray adsorbing layer) | Emulsion | 1.60 g/m$^2$ |
| | Colloidal silver silver; | 0.10 g/m$^2$ |
| | Ultraviolet ray absorbing agent (i) | 1.70 × 10$^{-4}$ mol/m$^2$ |
| | Color stain preventing agent (j) | 1.60 × 10$^{-4}$ mol/m$^2$ |
| | Solvent (k) | 0.24 g/m$^2$ |
| The 3rd layer (green-sensitive layer) | Emulsion silver; | 0.17 g/m$^2$ |
| | Gelatin | 1.56 g/m$^2$ |
| | Magenta coupler (f) | 3.38 × 10$^{-4}$ mol/m$^2$ |
| | Dye stabilizer (g) | 0.19 g/m$^2$ |
| | Solvent (h) | 0.59 g/m$^2$ |
| | Development accelerator (d) | 32 mg/m$^2$ |
| | Nucleating agent and nucleation accelerator | |
| The 2nd layer (color stain preventing layer) | Emulsion | 0.90 g/m$^2$ |
| | Colloidal silver silver; | 0.02 g/m$^2$ |
| | Color stain preventing agent (e) | 2.33 × 10$^{-4}$ mol/m$^2$ |
| The 1st layer (Red-sensitive layer) | Emulsion silver; | 0.39 g/m$^2$ |
| | Gelatin | 0.90 g/m$^2$ |
| | Cyan coupler (a) | 7.05 × 10$^{-4}$ mol/m$^2$ |
| | Dye stabilizer (b) | 5.20 × 10$^{-4}$ mol/m$^2$ |
| | Solvent (c) | 0.22 g/m$^2$ |
| | Development accelerator (d) | 32 mg/m$^2$ |
| | Nucleating agent and nucleation accelerator | |
| Support | Polyethylene-laminated paper (polyethylene on the first layer side contains white pigment ($TiO_2$, etc.) and bluish dye (ultramarine, etc.) | |
| Anticurl backing layer | Gelatin | 2.70 g/m$^2$ |

Red-sensitive dye:

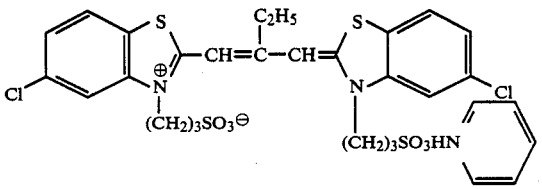

Green-sensitive dye:

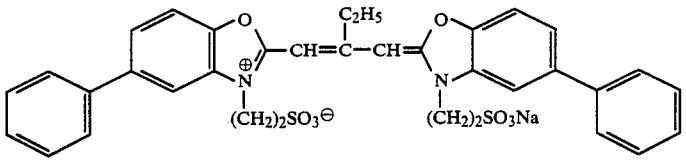

Blue-sensitive dye:

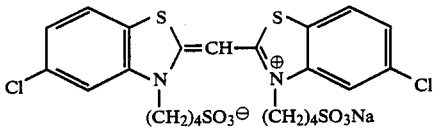

The following dyes were used as irradiation-preventing dyes.

Irradiation-preventing dye for green-sensitive emulsion layer (compound a):

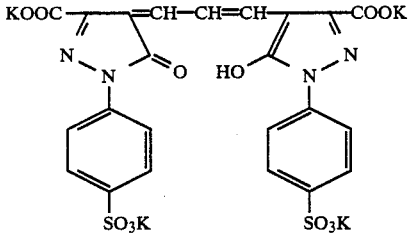

Irradiation-preventing dye for red-sensitive emulsion layer (compound b):

-continued
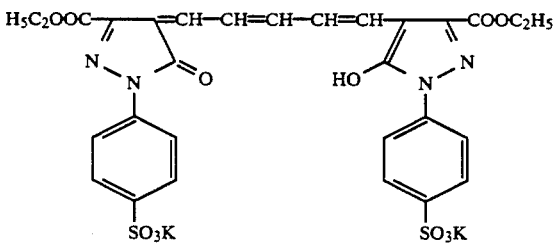
The following are the constitutional formulae of the compouns used in this Example.
(a) Cyan coupler:
Mixture of 1:1 (mol ratio) of the compounds represented by the following formulae:
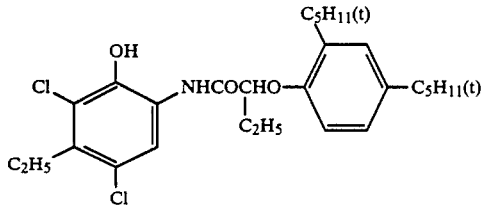
and
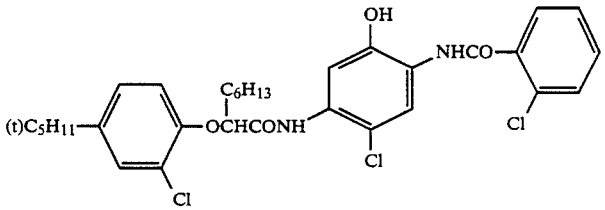
(b) Dye stabilizer:
Mixture of 1:3:3 (mol ratio) of the compounds represented by the following formulae:
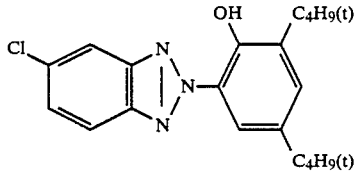
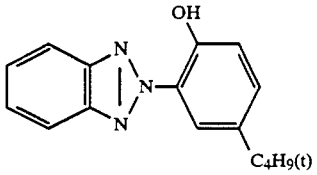
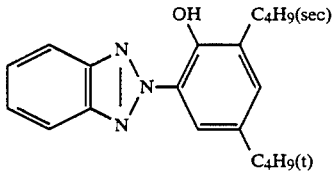
(c) Solvent:
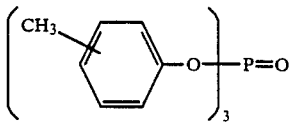
(d) Development accelerator:

-continued
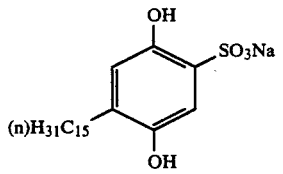
(e) Colôr stain preventing agent:
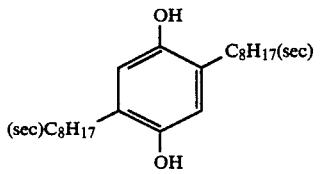
(f) Magenta coupler:
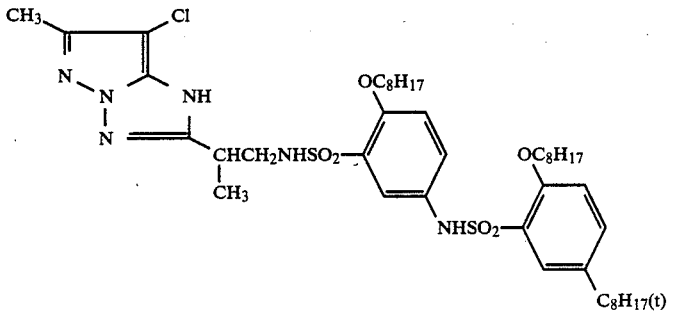
(g) Dye stabilizer:
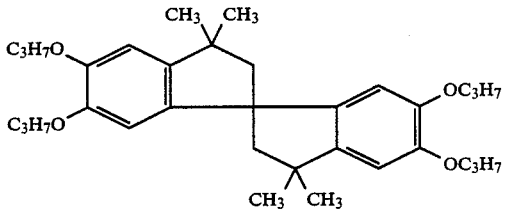
(h) Solvent:
Mixture of 2:1 (weight ratio) of the compounds represented by the following formulae:
$((n)C_8H_{17}O)_3P{=}O$
and
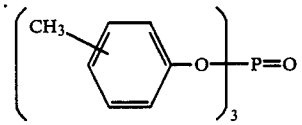
(i) Ultraviolet ray absorbing agent:
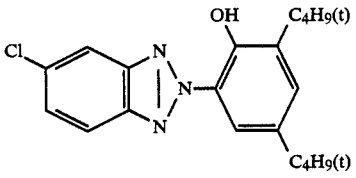

-continued
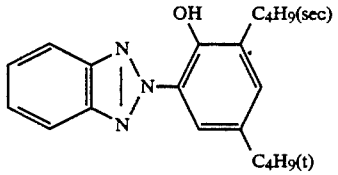
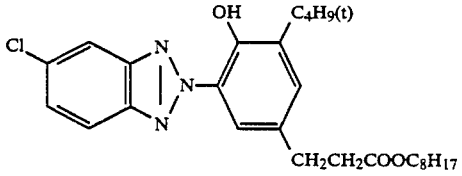
(j) Color stain preventing agent:
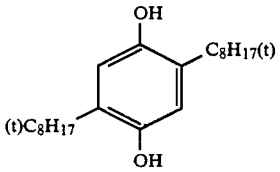
(k) Solvent:
$(iso C_9H_{19}O)_3P{=}O$
(l) Yellow coupler:
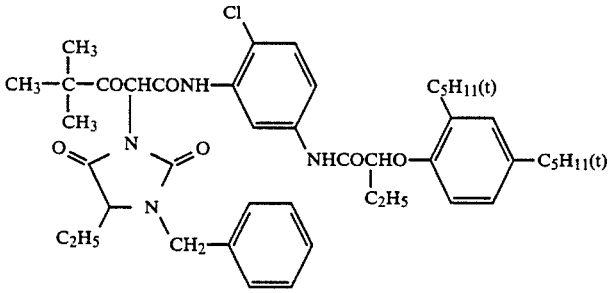
(m) Dye stabilizer:
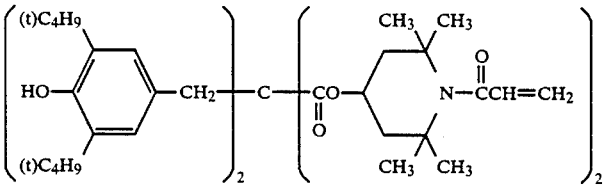
Nucleating agent:
Mixture of 1:1 (mol ratio) of the compounds represented by the following formulae:
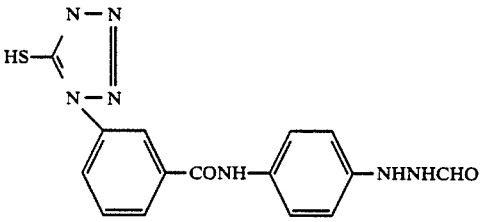
and -continued

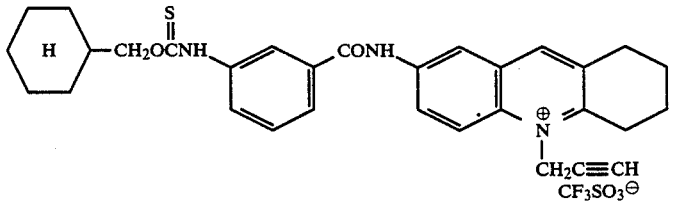

Nucleation accelerator:

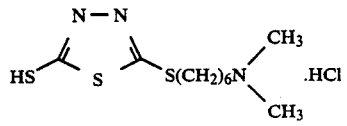

Production of Specimens 102 to 110

Specimens 102 to 110 were prepared in a manner similar to specimen 101 except using the compounds given in Table 1 in place of the irradiation-preventing dyes for the green-sensitive emulsion layer and the red-sensitive emulsion layer of specimen 101.

The photographic materials prepared above were exposed to light through continuous wedges and developed by the procedure described below.

Also, the above-mentioned photographic materials were preserved under the conditions of 40° C. and 70% RH for a week and then developed in the same way to determine the densities of cyan, magenta and yellow.

The logarithms (log E) of the reciprocals of exposure needed to obtain a color density of 0.5 as to each of cyan, magneta and yellow were determined before and after being preserved under the conditions of 40° C. and 70% RH for a week to calculate the difference (Δ log E) between before and after the preservation for a week. When the difference Δ log E was a positive number, it can be said that the sensitivity of the photographic material was decreased after being preserved under the conditions of 40° C. and 70% RH for a week.

Also, the sharpness was evaluated by measuring MTF values.

| | Time | Temperature |
|---|---|---|
| Color development | 2 min. 30 sec. | 38° C. |
| Bleach-fix | 1 min. 30 sec. | 38° C. |
| Stabilization (1) | 1 min. | 38° C. |
| Stabilization (2) | 1 min. | 38° C. |
| Stabilization (3) | 1 min. | 38° C. |

The system employed for replenishing the stabilizing baths was the so-called counter-current replenishment system which comprises replenishing the stabilizing bath (3), introducing the overflow solution from the stabilizing bath (3) into the stablizing bath (2), and introducing the overflow solution from the stabilizing bath (2) into the stabilizing bath (1).

Processing steps B and C used the same conditions as given for processing step A except for adjusting the pH value of the color developing solutions of B and C to 10.4 and 10.0, respectively.

| [Color developing solution] | Mother liquor |
|---|---|
| Diethylenetriaminepentaacetic acid | 2.0 g |
| Benzyl alcohol | 12.8 g |
| Diethylene glycol | 3.4 g |
| Sodium sulfite | 2.0 g |
| Sodium bromide | 0.26 g |
| Hydroxylamine sulfate | 2.60 g |
| Sodium chloride | 3.20 g |
| 3-Methyl-4-amino-N-ethyl-N-(β-methanesulfonamidoethyl)aniline | 4.25 g |
| Potassium carbonate | 30.0 g |
| Brightening agent (stilbene based) | 1.0 g |
| Water to make | 1000 ml |
| pH | 10.0 to 10.4 |

The pH value was adjusted with potassium hydroxide or hydrochloric acid.

| [Bleach-fix solution] | Mother liquor |
|---|---|
| Ammonium thiosulfate | 110 g |
| Sodium hydrogensulfite | 10 g |
| Ammonium diethylenetriamine-pentaacetato ferrate (monohydrate) | 56 g |
| Disodium ethylenediaminetetraacetate (dihydrate) | 5 g |
| 2-Mercapto-1,3,4-triazole | 0.5 g |
| Water to make | 1000 ml |
| pH | 6.5 |

pH was adjusted with aqueous ammonia or hydrochloric acid.

| [Stabilizing solution] | Mother liquor |
|---|---|
| 1-Hydroxyethylidene-1,1'-disulfonic acid (60%) | 1.6 ml |
| Bismuth chloride | 0.35 g |
| Polyvinyl pyrrolidone | 0.25 g |
| Aqueous ammonia | 2.5 ml |
| Nitrilotriacetic acid 3Na salt | 1.0 g |
| 5-Chloro-2-methyl-4-isothiazoline-3-one | 50 mg |
| 2-Octyl-4-isothiazoline-3-one | 50 mg |
| Brightening agent (4,4'-diamino-stylbene based) | 1.0 g |
| Water to make | 1000 ml |
| pH | 7.5 |

pH was adjusted with potassium hydroxide or hydrochloric acid.

TABLE 1

| Specimen No. | Dye for green-sensitive layer | Dye for red-sensitive layer | Cyan | | Magenta | | Yellow | |
|---|---|---|---|---|---|---|---|---|
| | | | Δlog E | MTF | Δlog E | MTF | Δlog E | MTF |
| 101 (Comparative) | Compound a | Compound b | +0.28 | 0.88 | +0.25 | 0.92 | +0.12 | 0.94 |
| 102 (Comparative) | — | — | −0.04 | 0.73 | −0.02 | 0.80 | −0.05 | 0.83 |
| 103 (this invention) | I-6 | I-10 | −0.02 | 0.89 | −0.02 | 0.93 | −0.03 | 0.95 |
| 104 (this invention) | I-6 | I-11 | −0.03 | 0.90 | −0.02 | 0.92 | −0.04 | 0.94 |
| 105 (this invention) | I-4 | I-10 | −0.02 | 0.88 | −0.01 | 0.93 | −0.04 | 0.93 |
| 106 (this invention) | I-18 | I-16 | −0.03 | 0.87 | −0.02 | 0.92 | −0.03 | 0.94 |
| 107 (this invention) | I-6 | I-20 | −0.04 | 0.88 | −0.03 | 0.91 | −0.05 | 0.94 |
| 108 (this invention) | I-23 | I-24 | −0.04 | 0.89 | −0.02 | 0.94 | −0.04 | 0.93 |
| 109 (this invention) | I-35 | I-37 | −0.01 | 0.89 | −0.02 | 0.92 | −0.04 | 0.94 |
| 110 (this invention) | I-44 | I-41 | −0.02 | 0.88 | −0.02 | 0.92 | −0.03 | 0.94 |

As shown in Table 1, the photographic materials of the present invention have the improvement of sharpness without decreasing sensitivity after a lapse of time in comparison with the comparative examples.

EXAMPLE 2

Specimen 201 was produced by applying each of the following layers onto a resin-coated paper support having 150 μm thick in the order from the support side.

The First Layer

An internal latent image type silver chlorobromoiodide emulsion was prepared according to the conversion method described in Example 1 of U.S. Pat. No. 2,592,250.

Then, 80 g of cyan coupler 2,4-dichloro-3-methyl-6-[α-(2,4-di-tert-amylphenoxy)butylamido]phenol, 2 g of 2,5-di-tert-octylhydroquinone, 100 g of dibutylphthalate, 200 g of paraffin, and 50 g of ethyl acetate were mixed and dissolved. The solution was dispersed in a gelatin solution containing sodium dodecylbenzenesulfonate. The resulting solution was added to the emulsion (containing 0.35 mol of silver chloroiodobromide) and then coated to obtain the first layer having 400 mg/m$^2$ of silver and 300 mg/m$^2$ of coupler.

The Second Layer 100 ml of 2.5% gelatin solution containing 5 g of grey colloidal silver and 10 g of 2,5-di-tert-octylhydroquinone dispersed in dibutyl phthalate was coated on the first layer so as to obtain the second layer having 400 mg/m$^2$ of colloidal silver.

The Third Layer

First, 100 g of magenta coupler 1-(2,4,6-trichlorophenyl)-3-(2-chloro-5-octadecylsuccinimidoanilino)-5-pyrazolone, 5 g of 2,5-di-tert-octylhydroquinone, 50 g of Sumiraizah MDP (made by Sumitomo Chemical Co., Ltd.), 200 g of paraffin, 100 g of dibutyl phthalate, and 50 g of ethyl acetate were mixed and dissolved. The solution was dispersed in a gelatin solution containing sodium dodecylbenzenesulfonate. The resulting solution was added to the internal latent image type silver chloroiodobromide emulsion in a manner similar to the first layer and then coated to obtain the third layer having 400 mg/m$^2$ of silver and 400 mg/m$^2$ of coupler.

The Fourth Layer

A 2.5% gelatin solution containing 5 g of yellow colloidal silver and 5 g of 2,5-di-tert-octylhydroquinone dispersed in dibutyl phthalate was coated on the third layer to obtain the fourth layer having 200 mg/m$^2$ of colloidal silver.

The Fifth Layer

First, 120 g of yellow coupler α-[4-(1-benzyl-2-phenyl-3,5-dioxo-1,2,4-triazolizinyl)]-α-pivalyl-2-chloro-5-[γ-(2,4-di-tert-amylphenoxy)butylamido]acetoanilide, 3.5 g of 2,5-di-tert-octylhydroquinone, 200 g of paraffin, 100 g of Tinuvin (made by Chiba Geigy Co., Ltd.), 100 g of dibutyl phthalate, and 70 ml of ethyl acetate were mixed and dissolved. The solution was dispersed in a gelatin solution containing sodium dodecylbenzenesulfonate. The resulting solution was added to the internal latent image type silver chloroiodobromide emulsion in a manner similar to the first layer and then coated on the fourth layer to obtain the fifth layer having 400 mg/m$^2$ of silver and 400 mg/m$^2$ of coupler.

The Sixth Layer

The sixth layer was coated to have 180 mg/m$^2$ of gelatin.

It is to be noted that the first, third and fifth layers contained 4-hydroxy-6-methyl-1,3,3a,7-tetraazaindene as a stabilizer. Also, the first, second, third, fourth, fifth and sixth layers contained bis(vinyl sulfonyl methyl)

ether as a hardening agent, and saponin as a coating aid to obtain specimen 201.

Production of Specimens 202 to 210

Specimens 202 to 210 were produced in a manner similar to specimen 201 except for adding $1.5\times10^{-4}$ mol/m$^2$ of each of the compounds given in Table 2 to the fifth layer of specimen 201.

The thus produced specimens 201 to 210 were exposed to light through wedges using a sensitometer and then fogged using a fluorescent lamp for color evaluation under the following light-fogging conditions to achieve the following development.

Also, specimens 201 to 210 were preserved under the conditions of 40° C. and 70%RH for a week, and then the same exposure and development processings referred to above were carried out.

The logarithms (log E) of the reciprocals of exposure needed to obtain a color density of 0.5 as to each of cyan, magenta and yellow were determined before and after being preserved under the conditions of 40° C. and 70%RH for a week to calculate the difference (Δ log E).

When the difference Δ log E has a positive number, it shows that the sensitivity of the photographic material was decreased after being preserved under the conditions of 40° C. and 70%RH for a week.

Processing Conditions

Color development (36° C., 135 sec., the light-fogging was carried out for 10 sec. after being immersed in a developing solution)—Bleach-fix (36° C., 40 sec.)—Stabilization (1) ((36° C., 40 sec.)—Stabilization (2) (36° C., 40 sec.).

Light Fogging Exposure Conditions

The illuminance was increased lineally to obtain the luminance of 4 lux after 9 seconds from the start of exposure, and the exposure was carried out for 9 seconds.

The processing temperature was 36° C. in each step. The following are the compositions of the processing solutions.

| [Color developing solution] | |
|---|---|
| Hydroxyethyliminodiacetic acid | 0.5 g |
| Monoethylene glycol | 9.0 g |
| Benzyl alcohol | 9.0 g |
| Monoethanolamine | 2.5 g |
| Sodium bromide | 2.3 g |
| Sodium chloride | 5.5 g |
| N,N-diethyl hydroxylamine | 5.9 g |
| 3-Methyl-4-amino-N-ethyl-N-(β-methanesulfonamidoethyl)aniline sulphate | 2.7 g |
| 3-Methyl-4-amino-N-ethyl-N-hydroxyethylaniline sulphate | 4.5 g |
| Potassium carbonate | 30.0 g |
| Brightening agent (stylbene based) | 1.0 g |
| Pure water to make | 1000 ml |
| pH | 10.30 |

pH was adjusted with potassium hydroxide or hydrochloric acid.

| [Stabilizing solution] | |
|---|---|
| 1-Hydroxyethylidene-1,1-disulfonic acid | 2.7 g |
| o-Phenylphenol | 0.2 g |
| Potassium chloride | 2.5 g |
| Bismuth chloride | 1.0 g |
| Zinc chloride | 0.25 g |
| Sodium sulfite | 0.3 g |
| Ammonium sulfate | 4.5 g |
| Brightening agent (stylbene based) | 0.5 g |
| Pure water to make | 1000 ml |
| pH | 7.2 |

pH was adjusted with potassium hydroxide or hydrochloric acid.

| [Bleach-fix Bath] | |
|---|---|
| Ammonium thiosulfate | 110 g |
| Sodium hydrogensulfite | 12 g |
| Ammonium diethylenetriamine-pentaacetato ferrate | 80 g |
| Diethylenetriaminepentaacetic acid | 5 g |
| 2-mercapto-5-amino-1,3,4-thiadiazol | 0.3 g |
| Pure water to make | 1000 ml |
| pH | 6.80 |

pH was adjusted with aqueous ammonia or hydrochloric acid.

TABLE 2

| Specimen No. | Dye: Dye for blue-sensitive layer | Dye: Dye for green-sensitive layer | Dye: Dye for red-sensitive layer | Cyan Δlog E | Cyan MTF | Magenta Δlog E | Magenta MTF | Yellow Δlog E | Yellow MTF |
|---|---|---|---|---|---|---|---|---|---|
| 201 (Comparative example) | — | — | — | −0.04 | 0.72 | −0.03 | 0.75 | −0.01 | 0.85 |
| 202 (Comparative example) | Compound e | Compound c | Compound d | 0.32 | 0.85 | 0.30 | 0.87 | 0.15 | 0.90 |
| 203 (This invention) | I-1 | I-6 | I-10 | −0.02 | 0.87 | −0.03 | 0.87 | −0.02 | 0.91 |
| 204 (This invention) | I-2 | I-7 | I-10 | −0.03 | 0.85 | −0.02 | 0.88 | −0.01 | 0.92 |
| 205 (This invention) | I-19 | I-6 | I-11 | −0.02 | 0.86 | −0.01 | 0.89 | −0.01 | 0.90 |
| 206 (This invention) | I-22 | I-12 | I-15 | −0.01 | 0.87 | −0.02 | 0.88 | −0.01 | 0.89 |
| 207 | I-21 | I-18 | I-14 | −0.04 | 0.87 | −0.03 | 0.87 | 0 | 0.91 |

TABLE 2-continued

| Specimen No. | Dye: Dye for blue-sensitive layer | Dye: Dye for green-sensitive layer | Dye: Dye for red-sensitive layer | Cyan Δlog E | Cyan MTF | Magenta Δlog E | Magenta MTF | Yellow Δlog E | Yellow MTF |
|---|---|---|---|---|---|---|---|---|---|
| (This invention) 208 (This invention) | I-2 | I-23 | I-16 | −0.03 | 0.85 | −0.01 | 0.86 | −0.01 | 0.90 |
| (This invention) 209 (This invention) | I-2 | I-26 | I-20 | −0.02 | 0.86 | −0.03 | 0.87 | −0.02 | 0.89 |
| (This invention) 210 (This invention) | I-2 | I-35 | I-34 | −0.03 | 0.86 | −0.02 | 0.87 | −0.01 | 0.91 |

As shown in Table 2, the photographic materials of the present invention have the improvement of sharpness without decreasing sensitivity after a lapse of time in comparison with the comparative examples.

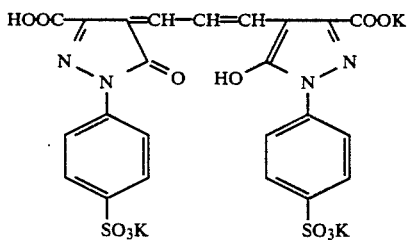

Compound c

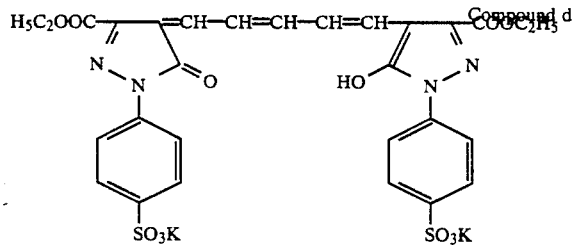

Compound d

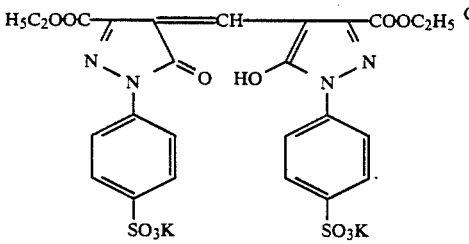

Compound e

EXAMPLE 3

Color photosensitive material 301 was produced by coating the 1st layer to the 14th layer on the surface of a paper support (100 μm thick) laminated with polyethylene on both sides and coating the 15th layer and the 16th layer on the back thereof. The polyethylene coated on the surface of the laminated paper support to have the 1st layer contained titanium white as a white pigment and a slight amount of ultramarine as a bluish dye.

[Composition of Photosensitive Layer]

The following is a description of the components and the coated amounts thereof given in units of g/m². It is to be noted that the coated amount of silver halide is given in the calculated amounts of silver. The emulsion used in each layer was produced according to the process for producing Emulsion EM1 discrubed below. It is to be noted that the emulsion of the 14th layer employed Lippmann emulsion having no chemical sensitization on the surface.

| | |
|---|---|
| The 1st layer (antihalation layer) | |
| The 2nd layer (intermediate layer) | |
| Gelatin | 1.00 |
| The 3rd layer (low-sensitive red-sensitive layer) | |
| Silver bromide (average grain size of 0.3 μm, size distribution (coefficient of variation) of 8%, octahedron) spectrally sensitized with red-sensitizing dyes (ExS-1, 2, 3) | 0.06 |
| Silver chlorobromide (5 mol % of silver chloride, average grain size of 0.45 μm, size distribution of 10%, octahedron) spectrally sensitized with red-sensitizing dyes (ExS-1, 2, 3) | 0.10 |
| Gelatin | 1.00 |
| Cyan coupler (ExC-1) | 0.11 |
| Cyan coupler (ExC-2) | 0.10 |
| Discoloration inhibitors (Cpd-2, 3, 4, 13 in equimolecular amounts) | 0.12 |
| Coupler-dispersion medium (Cpd-5) | 0.03 |
| Coupler solvents (Solv-7, 2, 3 in equimolecular amounts) | 0.06 |
| The 4th layer (high-sensitive red-sensitive layer) | |
| Silver bromide (average grain size of 0.60 μm, size distribution 15%, octahedron) spectrally sensitized with red-sensitizing dyes (ExS-1, 2, 3) | 0.14 |
| Gelatin | 1.00 |
| Cyan coupler (ExC-1) | 0.15 |
| Cyan coupler (ExC-2) | 0.15 |
| Discoloration inhibitors (Cpd-2, 3, 4, 13 in equimolecular amounts) | 0.15 |
| Coupler-dispersion medium (Cpd-5) | 0.03 |
| Coupler solvents (Solv-7, 2, 3 in equimolecular amounts) | 0.10 |
| The 5th layer (intermediate layer) | |
| Gelatin | 1.00 |
| Color stain preventing agent (Cpd-7) | 0.08 |
| Color stain preventing agent solvents (Solv-4, 5 in equimolecular amounts) | 0.16 |
| Polymer latex | 0.10 |
| The 6th layer (low-sensitive green-sensitive layer) | |
| Silver bromide (average grain size of 0.25 μm, grain size distribution of 8%, octahedron) spectrally sensitized with green-sensitizing dye (ExS-3) | 0.04 |
| Silver bromide (average grain size of 0.45 μm, grain size distribution of 11%, octahedron) spectrally sensitized with green-sensitizing dyes (ExS-3, 4) | 0.06 |
| Gelatin | 0.80 |
| Magenta couplers (ExM-1, 2 in equimolecular amounts) | 0.11 |

-continued

| | |
|---|---|
| Discoloration inhibitor (Cpd-9) | 0.10 |
| Stain-preventing agents (Cpd-10, 22 in equimolecular amounts) | 0.014 |
| Stain-preventing agent (Cpd-23) | 0.001 |
| Stain-preventing agent (Cpd-12) | 0.01 |
| Coupler dispersion medium (Cpd-5) | 0.05 |
| Coupler solvents (Solv-4, 6 in equimolecular amounts) | 0.15 |
| The 7th layer (high-sensitive green-sensitive layer) | |
| Silver bromide (average grain size of 0.8 μm, grain size distribution of 16%, octahedron) spectrally sensitized with green-sensitizing dyes (ExS-3, 4) | 0.10 |
| Gelatin | 0.80 |
| Magenta couplers (ExM-1, 2) | 0.11 |
| Discoloration inhibitor (Cpd-9) | 0.10 |
| Stain-preventing agents (Cpd-10, 22 in equimolecular amounts) | 0.013 |
| Stain-preventing agent (Cpd-23) | 0.001 |
| Stain-preventing agent (Cpd-12) | 0.01 |
| Coupler dispersion medium (Cpd-5) | 0.05 |
| Coupler solvents (Solv-4, 6 in equimolecular amounts) | 0.15 |
| The 8th layer (intermediate layer) | |
| The same as the fifth layer. | |
| The 9th layer (yellow filter layer) | |
| Yellow colloidal silver | 0.20 |
| Gelatin | 1.00 |
| Color stain preventing agent (Cpd-7) | 0.06 |
| Color stain preventing agent solvents (Solv-4, 5 in equimolecular amounts) | 0.15 |
| Polymer latex | 0.10 |
| The 10th layer (intermediate layer) | |
| The same as the fifth layer. | |
| The 11th layer (low sensitive blue-sensitive layer) | |
| Silver bromide (average grain size of 0.45 μm, coefficient of variation of 8%, octahedron) spectrally sensitized with blue-sensitizing dyes (ExS-5, 6) | 0.07 |
| Silver bromide (average grain size of 0.60 μm, size distribution 14%, octahedron) spectrally sensitized with blue-sensitizing dyes (ExS-5, 6) | 0.10 |
| Gelatin | 0.50 |
| Yellow coupler (ExY-1) | 0.22 |
| Stain-preventing agent (Cpd-11) | 0.001 |
| Discoloration inhibitor (Cpd-5) | 0.10 |
| Coupler dispersion medium (Cpd-5) | 0.05 |
| Coupler solvent (Solv-2) | 0.05 |
| The 12th layer (high-sensitive blue-sensitive layer) | |
| Silver bromide (average grain size of 1.2 μm, coefficient of variation 21%, octahedron) spectrally sensitized with blue-sensitizing dyes (ExS-5, 6) | 0.25 |
| Gelatin | 1.00 |
| Yellow coupler (ExY-1) | 0.41 |
| Stain-preventing agent (Cpd-11) | 0.002 |
| Discoloration inhibitor (Cpd-6) | 0.10 |
| Coupler dispersion medium (Cpd-5) | 0.05 |
| Coupler solvent (Solv-2) | 0.10 |
| The 13th layer (ultraviolet ray absorbing layer) | |
| Gelatin | 1.50 |
| Ultraviolet ray absorbing agents (Cpd-1, 3, 13 in equimolecular amounts) | 1.00 |
| Color stain preventing agents (Cpd-6, 14 in equimolecular amounts) | 0.06 |
| Dispersion medium (Cpd-5) | 0.05 |

-continued

| | |
|---|---|
| Ultraviolet ray absorbing agent solvent (Solv-1, 2 in equimolecular amounts) | 0.15 |
| Irradiation-preventing dye (Cpd-15) | 0.02 |
| Irradiation-preventing dye (Cpd-17) | 0.02 |
| The 14th layer (protective layer) | |
| Fine grain silver chlorobromide (97 mol % of silver chloride, average grain size of 0.2 μm) | 0.05 |
| Acryl-denatured copolymer of polyvinyl alcohol (denaturation degree of 17%) | 0.02 |
| Polymethylmethacrylate grain (average grain size of 2.4 μm) and silicon oxide (average grain size of 5 μm) in equimolecular amounts | 0.05 |
| Gelatin | 1.50 |
| Gelatin-hardening agent (H-1) | 0.17 |
| The 15th layer (backing layer) | |
| Gelatin | 2.50 |
| The 16th layer (protective layer on the back) | |
| Polymethyl methacrylate grain (average grain size of 2.4 μm) and silicon oxide (average grain size of 5 μm) in equimolecular amounts | 0.05 |
| Gelatin | 2.00 |
| Gelatin-hardening agent (H-1) | 0.11 |

Process for Producing Emulsion EM1

An aqueous solution of potassium bromide and an aqueous solution of silver nitrate were simultaneously added to an aqueous solution of gelatin with vigorous stirring at 75° C. for 15 minutes to obtain octahedron silver bromide grains having an average grain size of 0.40 μm. Next, 0.3 g of 3,4-dimethyl-1,3-thiazoline-2-thione, 4 mg of sodium thiosulfate and 5 mg of chloroauric acid (tetrahydrate) per 1 mol of silver of said emulsion were successively added to the emulsion and heated at 75° C. for 80 minutes to achieve the chemical sensitization processing. The third obtained grains were further grown as cores in the same precipitation circumstance as the first process to finally obtain an octahedron monodisperse core/shell silver bromide emulsion having an average grain size of 0.65 μm. The coefficient of variation of grain size was 10%. Next, 1.0 mg of sodium thiosulfate and 1.5 mg of chloroauric acid (tetrahydrate) per 1 mol of silver of the emulsion were added to the emulsion and heated at 60° C. for 45 minutes to achieve the chemical sensitization processing to obtain an internal latent image type silver halide emulsion.

Each photosensitive layer employed $10^{-3}$ wt% of ExZK-1 based on the coated amount of silver halide as a nucleating agent and $10^{-2}$ wt% of Cpd-24 as a nucleation accelerator. Moreover, each layer employed Alkanol XC (Dupont Co., Ltd.) and sodium alkylbenzenesulfonate as emulsion-dispersion aids and succinic acid ester and Magefac F-120 (made by Dainippon Ink and Chemicals, Inc.) as coating aids. The layers containing silver halide and colloidal silver employed Cpd-19, 20, 21 as stabilizers.

The following are the compounds used in this Example.

ExS-1

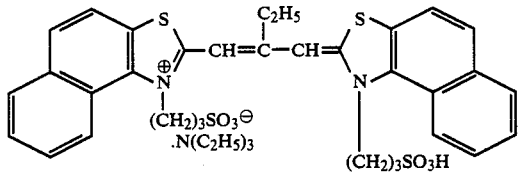

-continued
ExS-2
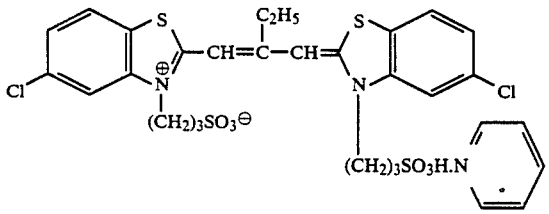
ExS-3
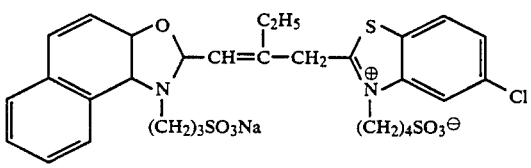
ExS-4
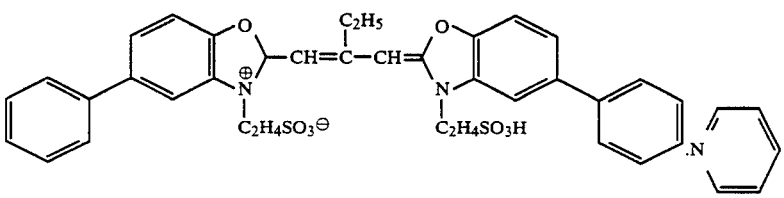
ExS-5
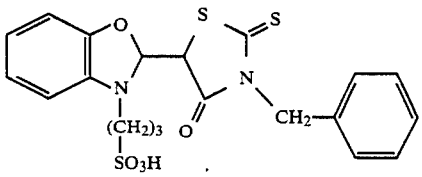
ExS-6
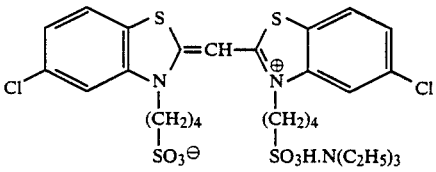
Cpd-1
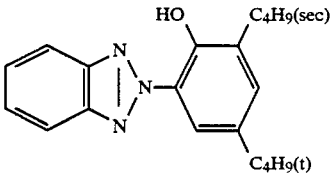
Cpd-2
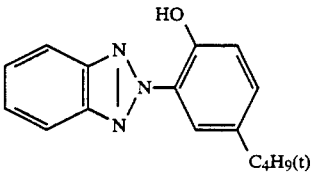
Cpd-3
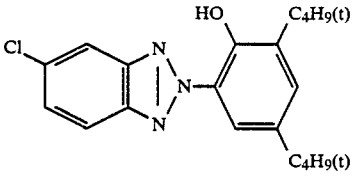

-continued
Cpd-4
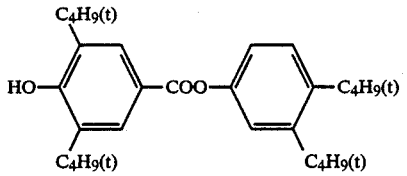
Cpd-5
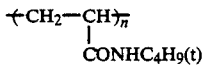
(n = 100~1000)
Cpd-6
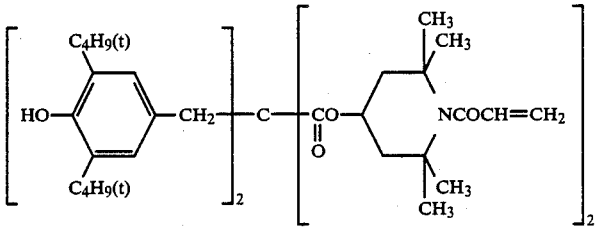
Cpd-7
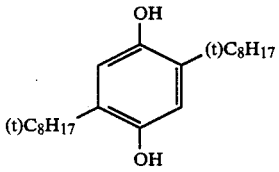
Polyethylacrylate
Cpd-8
Cpd-9
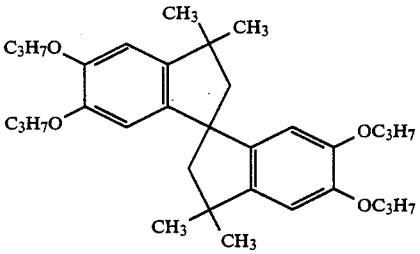
Cpd-10
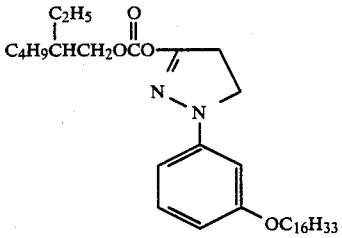
Cpd-11
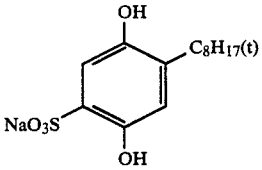

-continued
Cpd-12
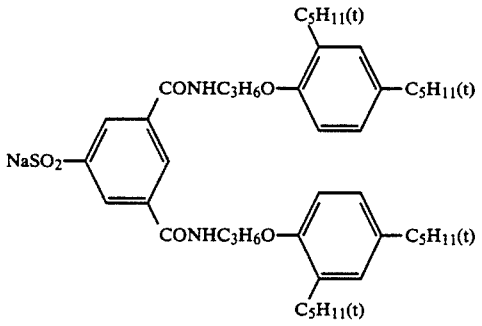
Cpd-13
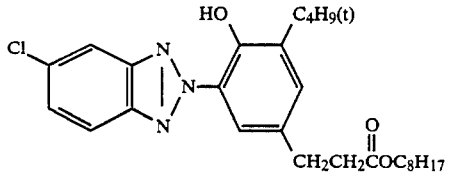
Cpd-14
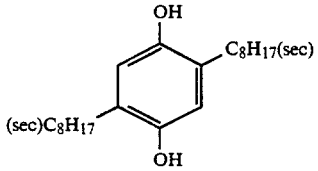
Cpd-15
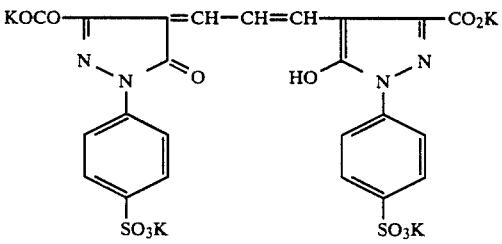
Cpd-17
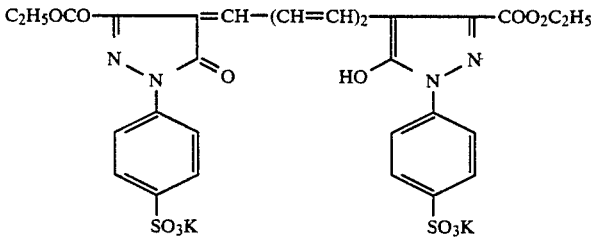
Cpd-19
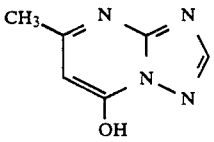
Cpd-20
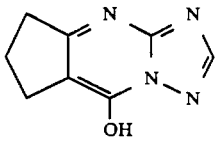
Cpd-21
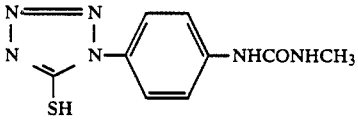

-continued
Cpd-22
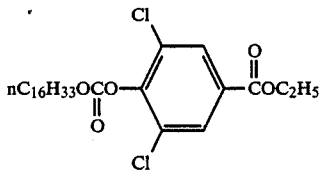
Cpd-23
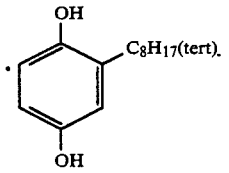
Cpd-24
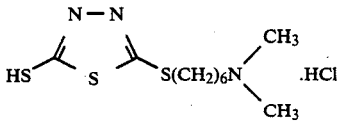
ExC-1
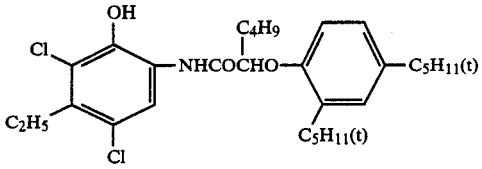
ExC-2
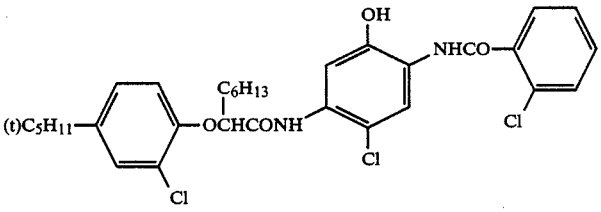
ExM-1
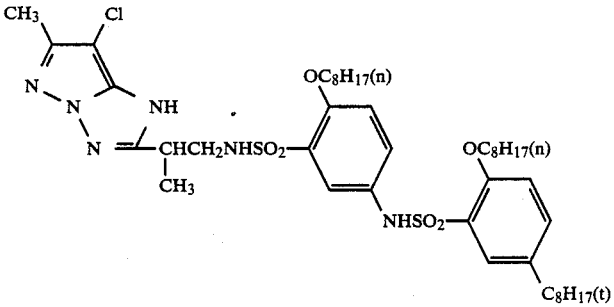
ExM-2
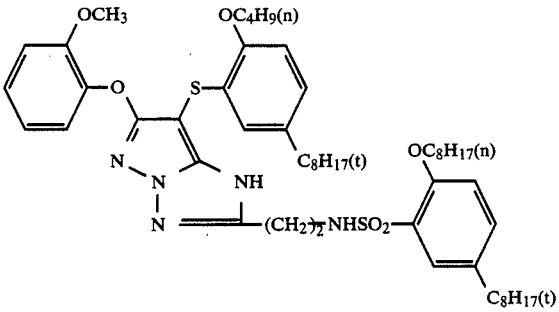

-continued

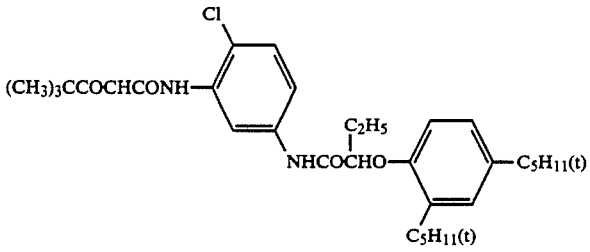

ExY-1

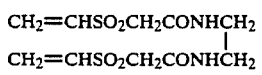

H-1

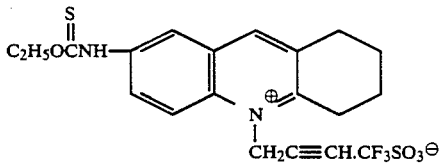

ExZK-1

Production of Specimens 302 to 308

Specimens 302 to 308 were produced in a manner similar to specimen 301 except using the compounds shown in Table 3 in place of the irradiation preventing dyes Cpd-15 and Cpd-17 used in specimen 301.

The thus produced photographic materials were exposed to light through continuous wedges and developed by the following processing steps.

Also, the above photographic materials were preserved under the conditions of 40° C. and 70%RH for a week, and then developed by the same steps to determine the densities of cyan and magenta. The logarithms (log E) of reciprocals of exposure needed to obtain a color density of 0.5 as to each of cyan and magneta were determined before and after being preserved under the conditions of 40° C. and 70% RH for a week to calculate the difference (Δ log E) between before and after the lapse of time of a week. When the difference Δ log E was a positive number, it can be said that the sensitivity of the photosensitive materials was decreased after being preserved under the conditions of 40° C. and 70%RH for a week.

| Processing Steps | Time | Temperature | Replenished amount |
|---|---|---|---|
| Color development | 80 sec. | 38° C. | 260 ml/m$^2$ |
| Bleach-fix | 30 sec. | 38° C. | 260 ml/m$^2$ |
| Water washing (1) | 30 sec. | 38° C. | |
| Water washing (2) | 30 sec. | 38° C. | 300 ml/m$^2$ |

In this case, the magnifying capacity of replenishment of the washing solution was 8.6 times.

| [Color developing solution] | Mother liquor | Replenished amount |
|---|---|---|
| Diethylenetriaminepentaacetic acid | 0.5 g | 0.5 g |
| 1-Hydroxyethylidene-1,1-diphosphoric acid | 0.5 g | 0.5 g |
| Diethylene glycol | 8.0 g | 10.7 g |
| Benzyl alcohol | 9.0 g | 12.0 g |
| Sodium bromide | 0.7 g | — |
| Sodium chloride | 0.5 g | — |
| Sodium sulfite | 2.0 g | 2.4 g |

-continued

| [Color developing solution] | Mother liquor | Replenished amount |
|---|---|---|
| Hydroxylamine sulfate | 2.8 g | 3.5 g |
| 3-Methyl-4-amino-N-ethyl-N-(β-methanesulfonamidoethyl)-aniline sulfate | 2.0 g | 2.5 g |
| 3-Methyl-4-amino-N-ethyl-N-(β-hydroxyethyl)aniline sulfate | 4.0 g | 4.5 g |
| Potassium carbonate | 30.0 g | 30.0 g |
| Brightening agent (stylbene based) | 1.0 g | 1.2 g |
| Pure water to make | 1000 ml | 1000 ml |
| pH | 10.50 | 10.90 |

pH was adjusted with potassium hydroxide and hydrochloric acid.

| [Bleach-fix solution] | Mother liquor | Replenished amount |
|---|---|---|
| Ammonium thiosulfate | 77 g | 100 g |
| Sodium hydrogensulfite | 14.0 g | 21.0 g |
| Ammonium ethylenediaminetetraacetato ferrate (dihydrate) | 40.0 g | 53.0 g |
| Disodium ethylenediaminetetraacetate (dihydrate) | 4.0 g | 5.0 g |
| 2-mercapto-1,3,4-triazol | 0.5 g | 0.5 g |
| Pure water to make | 1000 ml | 1000 ml |
| pH | 7.0 | 6.5 |

pH was adjusted with aqueous ammonia or hydrochloric acid.

[Washing Water]

Pure water was used (mother liquor=replenished solution).

TABLE 3

| | | Dye | | Cyan | Magenta |
|---|---|---|---|---|---|
| | | Magenta | Cyan | ΔlogE | ΔlogE |
| 301 | (Comparative example) | Cpd-15 | Cpd-17 | 0.32 | 0.29 |
| 302 | (Present invention) | " | I-10 | −0.01 | −0.01 |
| 303 | (Present | " | I-11 | −0.02 | −0.01 |

TABLE 3-continued

| | | Dye | | Cyan | Magenta |
|---|---|---|---|---|---|
| | | Magenta | Cyan | ΔlogE | ΔlogE |
| | invention) | | | | |
| 304 | (Present invention) | I-6 | Cpd-17 | 0.06 | 0.05 |
| 305 | (Present invention) | " | I-10 | 0.04 | 0.04 |
| 306 | (Present invention) | I-33 | I-15 | −0.03 | −0.02 |
| 307 | (Present invention) | I-25 | I-16 | −0.02 | −0.01 |
| 308 | (Present invention) | I-26 | I-27 | −0.02 | −0.02 |

The photographic materials of the present invention have a smaller changes of photographic performance obtained after the lapse of time in comparison with those of the Comparative Example.

The direct positive photographic materials of the present invention can provide direct positive images having excellent sharpness and also can be preserved under the conditions of high temperature and high humidity without decreasing any excellent sharpness.

While the invention has been described in detail and with reference to specific embodiments thereof, it will be apparent to one skilled in the art that various changes and modifications can be made therein without departing from the spirit and scope thereof.

What is claimed is:

1. A direct positive photographic material which has at least one previously-not-fogged internal latent image-type silver halide emulsion layer on a support, wherein said photographic material contains at least one compound represented by the following formula (I):

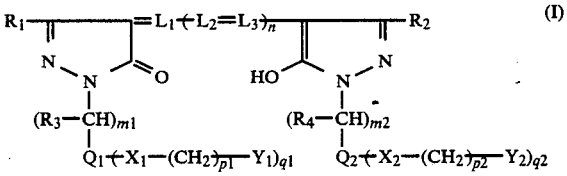

(I)

wherein each of $R_1$ and $R_2$ represents an alkyl group, an aryl group, a cyano group, $—COOR_5$, $—CONR_5R_6$, $—OR_5$, $—NR_5R_6$, $—NR_6SO_2R_7$, where each of $R_5$ and $R_6$ represents a hydrogen atom, an alkyl group or an aryl group; $R_7$ represents an alkyl or aryl group; $R_5$ and $R_6$, or $R_6$ and $R_7$ may link together to form a 5- or 6-membered ring; each of $R_3$ and $R_4$ represents a hydrogen atom or an alkyl group; each of $Q_1$ and $Q_2$ represents an aryl group; each of $X_1$ and $X_2$ represents a bond or a divalent linking group; each of $Y_1$ and $Y_2$ represents a sulfo group or a carboxyl group; each of $L_1$, $L_2$ and $L_3$ represents a methine group; n represents 0, 1, or 2; each of $m_1$ and $m_2$ represents 1 or 2; each of $p_1$ and $p_2$ represents 0, 1, 2, 3 or 4; and each of $q_1$ and $q_2$ represents 1 or 2.

2. The direct positive photographic material as claimed in claim 1, wherein said alkyl group represented by $R_1$, $R_2$, $R_5$, $R_6$ or $R_7$ is an alkyl group having 1 to 8 carbon atoms, which may be substituted with a halogen atom, a phenyl group, a hydroxy group, a cyano group, an alkoxy group, an aryloxy group, a carboxyl group or a sulfo group.

3. The direct positive photographic material as claimed in claim 1, wherein said alkyl group represented by $R_3$ or $R_4$ is an alkyl group having 4 or less carbon atoms.

4. The direct positive photographic material as claimed in claim 1, wherein said aryl group represented by $R_1$, $R_2$, $R_5$, $R_6$ or $R_7$ is a phenyl group or a naphthyl group, which may be substituted with a halogen atom, a sulfo group, a carboxy group, a hydroxyl group, a cyano group, an alkyl group having 1 to 4 carbon atoms, an alkoxy group or an aryloxy group.

5. The direct positive photographic material as claimed in claim 1, wherein said aryl group represented by $Q_1$ or $Q_2$ is a phenyl group or a naphthyl group, which may be substituted with a substituent excluding a sulfo group and a carboxyl group.

6. The direct positive photographic material as claimed in claim 1, wherein said divalent linking group represented by $X_1$ or $X_2$ is $$—O—,\ —\overset{R_8}{\overset{|}{N}}—,\ —\overset{R_8}{\overset{|}{N}}—CO—,\ —SO_2— \text{ or } —\overset{R_8}{\overset{|}{N}}—SO_2—,$$

wherein $R_8$ represents a hydrogen atom, an alkyl group having 5 or less carbon atoms, or a substituted alkyl group having 5 or less carbon atoms.

7. The direct positive photographic material as claimed in claim 1, wherein said 5- or 6-membered ring to be formed by linking $R_5$ and $R_6$, or $R_6$ and $R_7$ together is a piperidine ring, a morpholine ring, a pyrrolidine ring, or a pyrrolidone ring.

8. The direct positive photograhic material as claimed in claim 1, wherein said methine group represented by $L_1$, $L_2$ or $L_3$ has a substituent.

9. The direct positive photographic material as claimed in claim 1, wherein said sulfo group or said carboxyl group represented by $Y_1$ or $Y_2$ is present in the form of the free acid or salt.

10. The direct positive photographic material as claimed in claim 1, wherein each of $R_3$ and $R_4$ represents a hydrogen atom or a methyl group, each of $Q_1$ and $Q_2$ represents a phenyl group substituted phenyl group, and each of $X_1$ and $X_2$ represents $$—O—,\ —\overset{R_8}{\overset{|}{N}}—$$

wherein $R_8$ represents a hydrogen atom, an alkyl group having 5 or less carbon atoms or a substituted alkyl group having 5 or less carbon atoms, or a bond.

11. The direct positive photographic material as claimed in claim 10, wherein $m_1$ and $m_2$ represent 1.

12. The direct positive photographic material as claimed in claim 11, wherein each of $R_1$ and $R_2$ represents an alkyl group, an aryl group, a cyano group, $—COOR_5$, $—CONR_5R_6$ or $—NR_6SO_2R_7$ wherein each of $R_5$ and $R_6$ represents a hydrogen atom, an alkyl group or an aryl group, $R_7$ represents an alkyl group, and $R_5$ and $R_6$, or $R_6$ and $R_7$, may link together to form a 5- or 6-membered ring.

13. The direct positive photographic material as claimed in claim 1, wherein said compound represented by formula (I) is contained in amounts of 0.0003 to 0.5 $g/m^2$.

14. The direct positive photographic material as claimed in claim 13, wherein said compound represented by formula (I) is contained in amounts of 0.001 to 0.2 $g/m^2$.

15. The direct positive photographic material as claimed in claim 1, further containing a quaternary heterocyclic compound represented by formula (N-I):

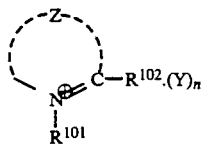

(N-I)

wherein Z represents a group of non-metallic atoms which are required to form a 5- or 6-membered heterocyclic ring which may be substituted, $R^{101}$ is an aliphatic group which may be substituted, $R^{102}$ is a hydrogen atom, an aliphatic group or an aromatic group which may be substituted, Y is a counter ion for balancing the electrical charge, and n is 0 or 1, provided that $R^{102}$ and Z may be joined together to form a ring, that at least one of the groups represented by $R^{101}$, $R^{102}$ and Z represents an alkynyl group, an acyl group, a hydrazine group or a hydrazone group, or $R^{101}$ and $R^{102}$ form a 6-membered ring a dihydropyridinum skeleton is formed, and that at least one of the substituents of $R^{101}$, $R^{102}$ and Z may have an $X^1$—$(L^1)_n$—group, wherein $X^1$ is a group which promotes adsorption on silver halide, $L^1$ is a divalent linking group, and m is 0 or 1.

16. The direct positive photographic material as claimed in claim 1, further containing a hydrazine based compound represented by formula (N-II):

$$R^{121}-N(R^{123})-N(R^{124})-G-R^{122} \quad \text{(N-II)}$$

wherein $R^{121}$ represents an aliphatic group, an aromatic group or a heterocyclic group, $R^{122}$ represents a hydrogen atom, an alkyl group, an aralkyl group, an aryl group, an alkoxy group, an aryloxy group or an amino group, G represents a carbonyl group, a sulfonyl group, a sulfoxy group, a phosphoryl group or an iminomethylene group (N=C<), and $R^{123}$ and $R^{124}$ both represent hydrogen atoms or one represents a hydrogen atom and the other represents an alkylsulfonyl group, an arylsulfonyl group or an acyl group, provided that a hydrazone structure (>N—N=C) may be formed containing G, $R^{122}$, $R^{124}$ and the hydrazine nitrogen.

17. The direct positive photographic material as claimed in claim 15, wherein the amount of said quaternary heterocyclic compound is within the range from $10^{-8}$ to $10^{-2}$ mol per mol of silver halide.

18. The direct positive photographic material as claimed in claim 17, wherein the amount is within the range from $10^{-7}$ to $10^{-3}$ mol per mol of silver halide.

19. The direct positive photographic material as claimed in claim 16, wherein the amount of said hydrazine based compound is within the range from $10^{-8}$ to $10^{-2}$ mol per mol of silver halide.

20. The direct positive photographic material as claimed in claim 19, wherein the amount is within the range from $10^{-7}$ to $10^{-3}$ mol per mol of silver halide.

* * * * *